US010094602B2

(12) United States Patent
Hanafusa et al.

(10) Patent No.: US 10,094,602 B2
(45) Date of Patent: Oct. 9, 2018

(54) CONDENSER

(71) Applicant: KEIHIN THERMAL TECHNOLOGY CORPORATION, Oyama-shi (JP)

(72) Inventors: Tatsuya Hanafusa, Oyama (JP); Makoto Numasawa, Oyama (JP); Koutarou Hagiwara, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 258 days.

(21) Appl. No.: 14/819,439

(22) Filed: Aug. 6, 2015

(65) Prior Publication Data

US 2016/0040916 A1 Feb. 11, 2016

(30) Foreign Application Priority Data

Aug. 8, 2014 (JP) ..... 2014-162118

(51) Int. Cl.
*F28F 9/02* (2006.01)
*F25B 39/04* (2006.01)
*F25B 40/02* (2006.01)

(52) U.S. Cl.
CPC ..... *F25B 39/04* (2013.01); *F25B 40/02* (2013.01); *F25B 2339/0441* (2013.01); *F25B 2339/0445* (2013.01); *F25B 2500/01* (2013.01)

(58) Field of Classification Search
CPC .... F25B 39/04; F25B 40/02; F25B 2339/044; F25B 2339/0441; F25B 2339/0445
See application file for complete search history.

(56) References Cited

U.S. PATENT DOCUMENTS 6,981,389 B2 * 1/2006 Knecht ..... F25B 43/003 62/474
2009/0173102 A1 * 7/2009 Ogasawara ..... F25B 39/04 62/498
2011/0186277 A1 8/2011 Hanafusa

FOREIGN PATENT DOCUMENTS

WO WO 2010/047320 4/2010

* cited by examiner

*Primary Examiner* — Len Tran
*Assistant Examiner* — Kamran Tavakoldavani
(74) *Attorney, Agent, or Firm* — Mori & Ward, LLP

(57) ABSTRACT

A condenser includes a condensation section, a super-cooling section, and a liquid receiving section. Refrigerant from heat exchange tubes of a first heat exchange path of the condensation section flows into those of a second heat exchange path through the liquid receiving section. The liquid receiving section includes a first space for receiving refrigerant from the heat exchange tubes of the first heat exchange path, a second space which is located above the first space and in which refrigerant from the first space is separated into gaseous and liquid phases, and a third space which is located below the first space, which receives refrigerant from the second space, and from which refrigerant flows to the heat exchange tubes of the second heat exchange path. A first partition member between the first space and the second space has a throttle for refrigerant flowing from the first space into the second space.

4 Claims, 13 Drawing Sheets

CONDENSER

BACKGROUND OF THE INVENTION

The present invention relates to a condenser suitable for use in, for example, a car air conditioner which is a refrigeration cycle mounted on an automobile.

Herein and in the appended claims, the upper side, lower side, left-hand side, and right-hand side of FIGS. 1, 8, and 11 will be referred to as "upper," "lower," "left," and "right," respectively.

The present applicant has proposed a condenser for a car air conditioner (see the pamphlet of WO2010/047320). The proposed condenser has a condensation section, a super-cooling section provided below the condensation section, and a liquid receiving section disposed in such a manner that its longitudinal direction coincides with the vertical direction. The condensation section includes at least two refrigerant condensation paths each formed by a plurality of heat exchange tubes disposed in parallel such that their longitudinal direction coincides with the left-right direction and they are spaced from one another in the vertical direction. The super-cooling section includes at least one refrigerant super-cooling path formed by a plurality of heat exchange tubes disposed in parallel such that their longitudinal direction coincides with the left-right direction and they are spaced from one another in the vertical direction. The refrigerant flowing out of the heat exchange tubes of the refrigerant condensation path at the lower end flows into the heat exchange tubes of the refrigerant super-cooling path at the upper end through the liquid receiving section. The condensation section includes the at least two refrigerant condensation paths and a condensation section outlet header section with which downstream end portions (in the refrigerant flow direction) of the heat exchange tubes of the refrigerant condensation path at the lower end communicate. The super-cooling section includes the at least one refrigerant super-cooling path and a super-cooling section inlet header section which is located on the same side as the condensation section outlet header section in the left-right direction and is located below the condensation section outlet header section. Upstream end portions (in the refrigerant flow direction) of the heat exchange tubes of the refrigerant super-cooling path at the upper end communicate with the super-cooling section inlet header section. The lower end of the liquid receiving section is located below the lower end of the condensation section outlet header section, and the upper end of the liquid receiving section is located above the lower end of the condensation section outlet header section. A first header tank and a second header tank are disposed at the left end or right end of the condenser in such a manner that the second header tank is located on the outer side of the first header tank in the left-right direction. The heat exchange tubes of the condensation section, excluding the heat exchange tubes of the lower-end refrigerant condensation path, are connected to the first header tank. The heat exchange tubes of the lower-end refrigerant condensation path of the condensation section and all the heat exchange tubes of the super-cooling section are connected to the second header tank. The lower end of the second header tank is located below the lower end of the first header tank, and the upper end of the second header tank is located above the lower end of the first header tank. The heat exchange tubes of the lower-end refrigerant condensation path of the condensation section and all the heat exchange tubes of the super-cooling section are connected to a portion of the second header tank located below the lower end of the first header tank. The condensation section outlet header section and the super-cooling section inlet header section are provided in the portion of the second header tank located below the lower end of the first header tank in such a manner that the former is located above the latter and the former and the latter communicate with each other. The second header tank also functions as the liquid receiving section.

In the condenser disclosed in the above-mentioned publication, the state of the refrigerant in the lower-end refrigerant condensation path becomes approximately the same as the state of the refrigerant in the second header tank, and the refrigerant is super cooled slightly even in the lower-end refrigerant condensation path.

Incidentally, the size of such a condenser must be decreased in some cases because of the restriction on the layout of the condenser in relation to other devices in the engine room of an automobile. For example, in an automobile on which an engine with a supercharger is mounted, a charge air cooler is generally used so as to cool compressed intake air to thereby increase the density of the intake air and improve the combustion efficiency of the engine. The charger are cooler may be disposed on the front side of a radiator to be located below the condenser. In such a case, the size of the condenser must be decreased.

Reducing the size of the condenser results in an increase in heat exchange load. In the case where the size of the condenser disclosed in the above-described publication is reduced, the super-cooling region is fixedly determined by the number of tubes inserted into the second header tank, whereby the condensation region may become insufficient. Therefore, it is expected that the condensation section fails to exhibit sufficient condensation performance under a specific condition regarding changes of an external environment such as temperature and wind speed.

SUMMARY OF THE INVENTION

In view of the above-described circumstances, an object of the present invention is to provide a condenser in which the stability of the condensation performance of the condensation section against changes of an external environment is improved even when the size of the condenser is reduced.

A condenser of the present invention has a condensation section, a super-cooling section provided below the condensation section, and a liquid receiving section provided between the condensation section and the super-cooling section and formed of a tubular member whose longitudinal direction coincides with a vertical direction and which is closed at upper end lower ends thereof. The condensation section includes at least one refrigerant condensation path composed of a plurality of heat exchange tubes disposed in parallel such that their longitudinal direction coincides with a left-right direction and they are spaced apart from one another in the vertical direction. The super-cooling section includes at least one refrigerant super-cooling path composed of a plurality of heat exchange tubes disposed in parallel such that their longitudinal direction coincides with the left-right direction and they are spaced apart from one another in the vertical direction. Refrigerant flowing out of the heat exchange tubes of the refrigerant condensation path at a lower end flows into the heat exchange tubes of the refrigerant super-cooling path at an upper end. The liquid receiving section includes a first space into which the refrigerant flows from the heat exchange tubes of the refrigerant condensation path at the lower end, a second space which is located above the first space, into which the refrigerant flows from the first space, and in which the refrigerant is separated into gaseous and liquid phases, and a third space which is located below the first space, into which the refrigerant flows from the second space, and from which the refrigerant flows into the heat exchange tubes of the refrigerant super-cooling path at the upper end. A throttle is provided in a region through which the refrigerant flows from the first space into the second space.

DESCRIPTION OF THE PREFERRED EMBODIMENTS

Embodiments of the present invention will next be described with reference to the drawings.

Figure 1:
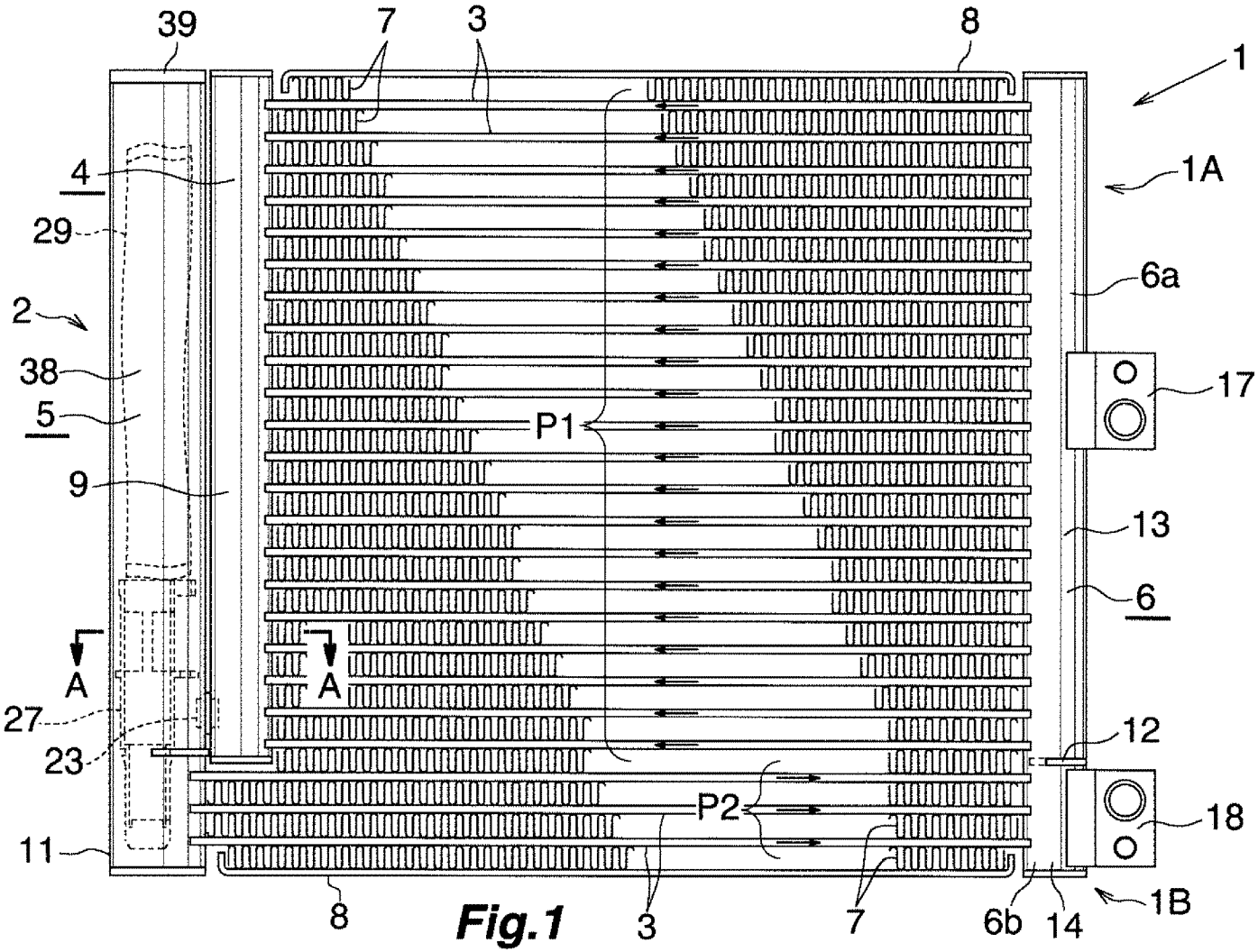
FIG. 1 is a front view specifically showing the overall structure of a condenser according to a first embodiment of the present invention.
Figure 8:
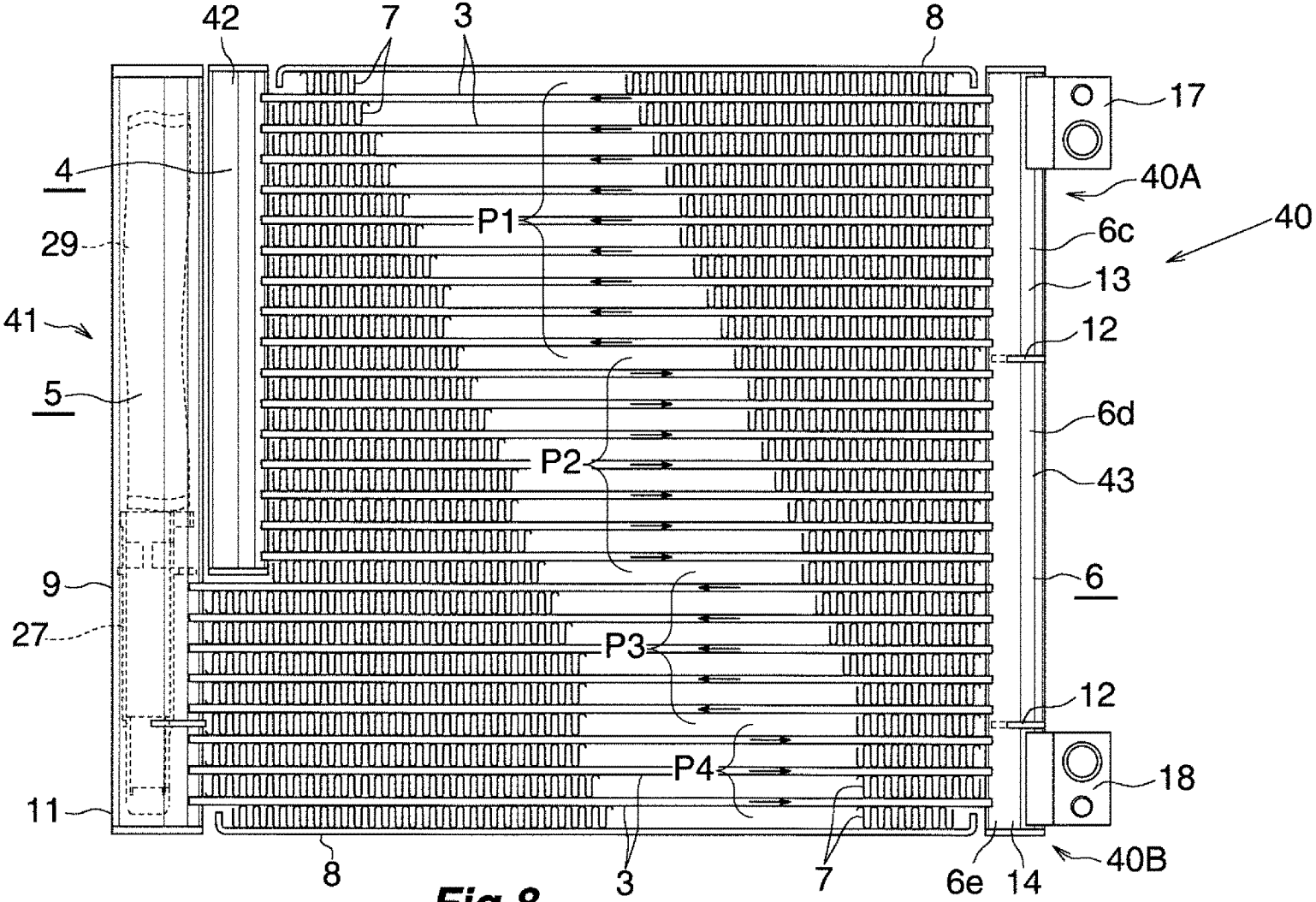
FIG. 8 is a front view specifically showing the overall structure of a condenser according to a second embodiment of the present invention.
Figure 11:
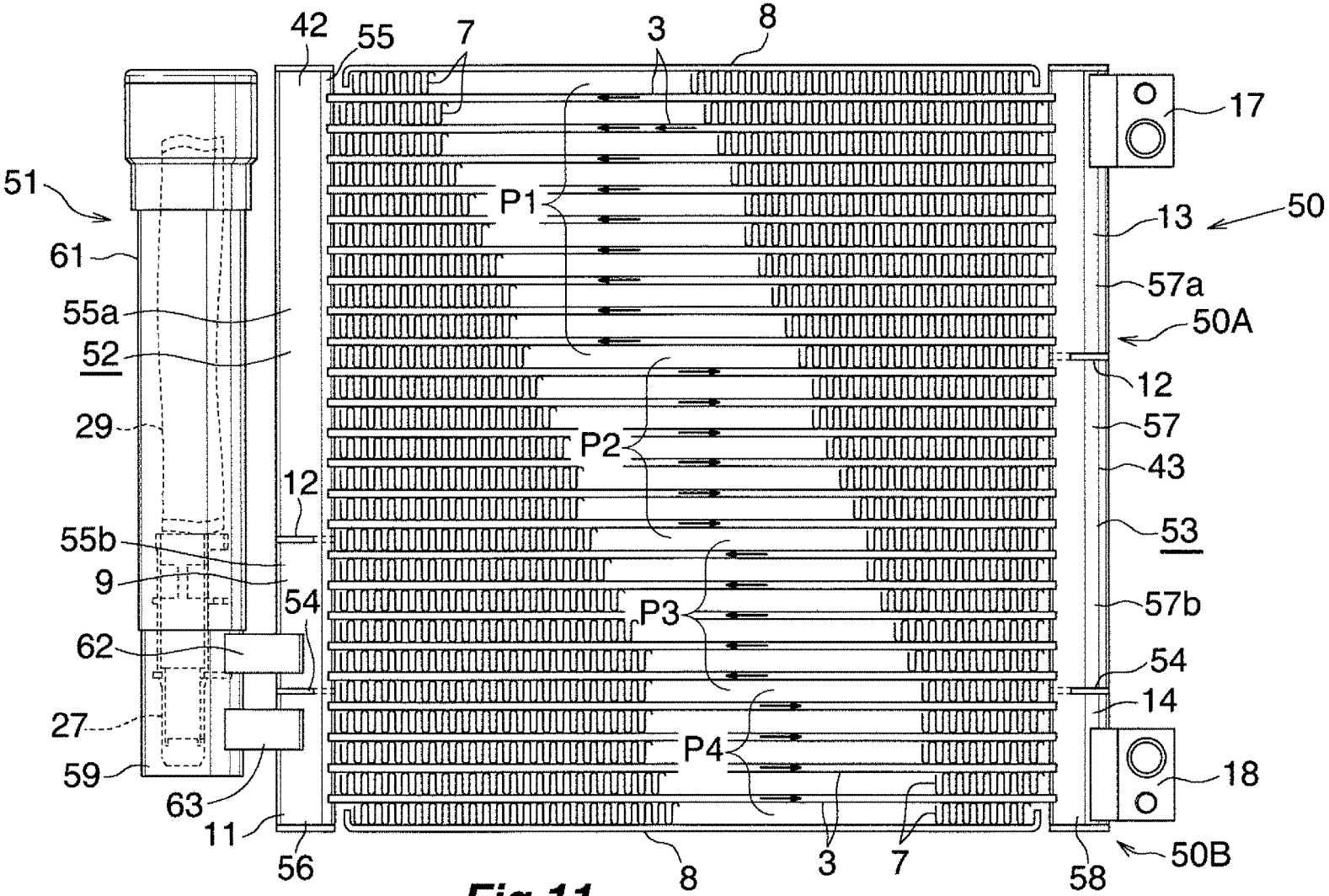
FIG. 11 is a front view specifically showing the overall structure of a condenser according to a third embodiment of the present invention.

In the following description, the reverse side of the sheets on which FIG. 1, FIG. 8, and FIG. 11 are drawn (the upper side of FIG. 3) will be referred to as "front" and the opposite side will be referred to as "rear."

The term "aluminum" as used in the following description encompasses aluminum alloys in addition to pure aluminum.

Like portions and components are denoted by like reference numerals throughout the drawings.

First Embodiment

This embodiment is shown in FIGS. 1 through 6.

Figure 2:
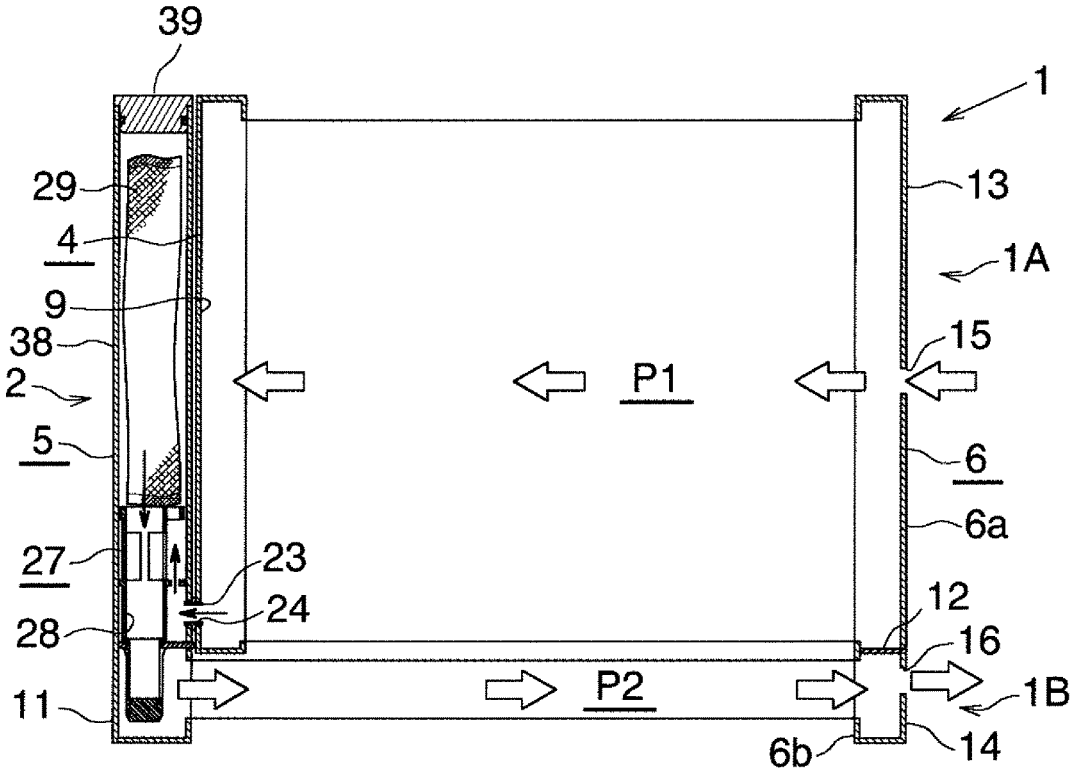
FIG. 2 is a front view schematically showing the condenser of FIG. 1.
Figure 3:
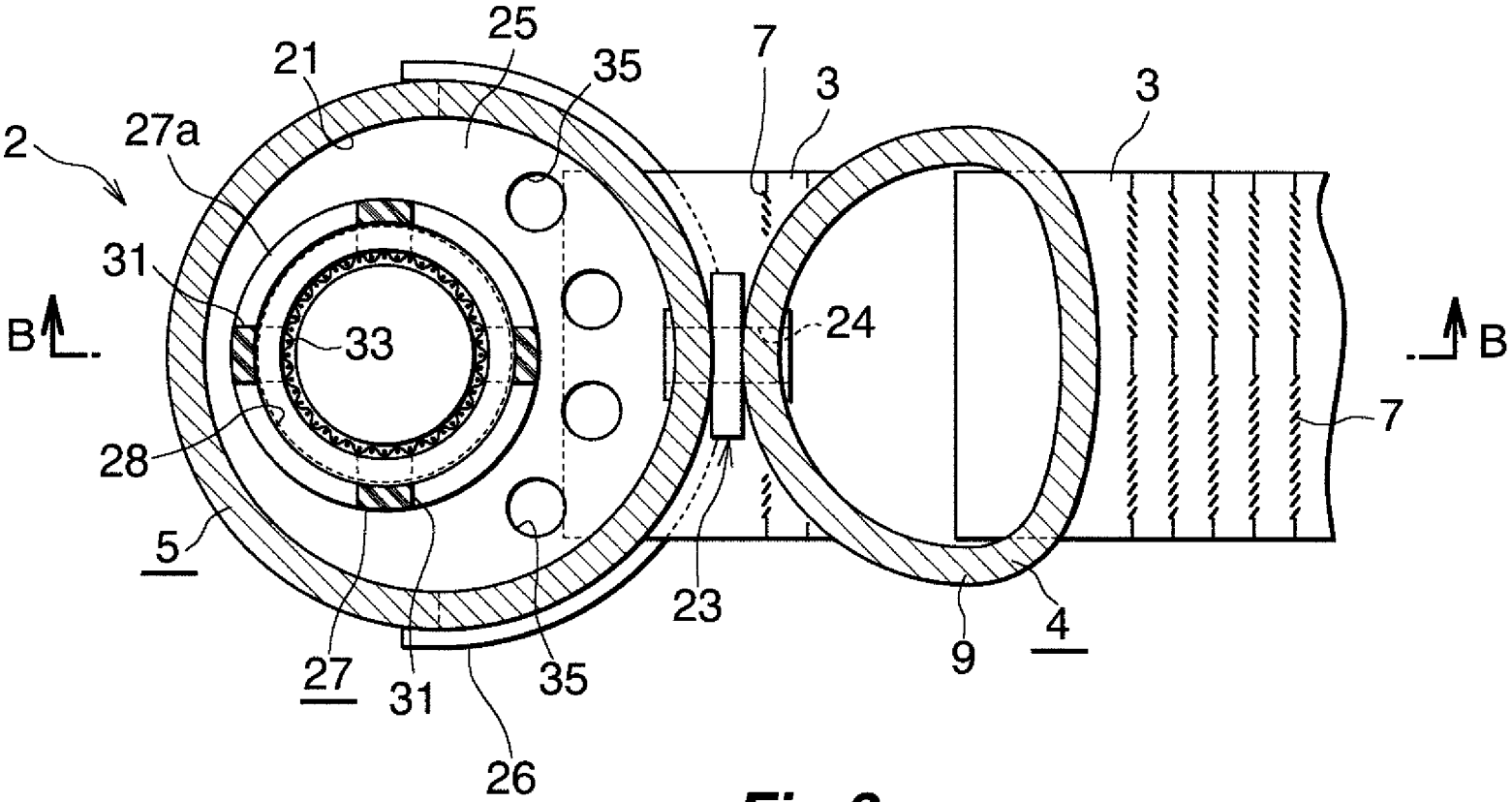
FIG. 3 is an enlarged sectional view taken along line A-A of FIG. 1.
Figure 4:
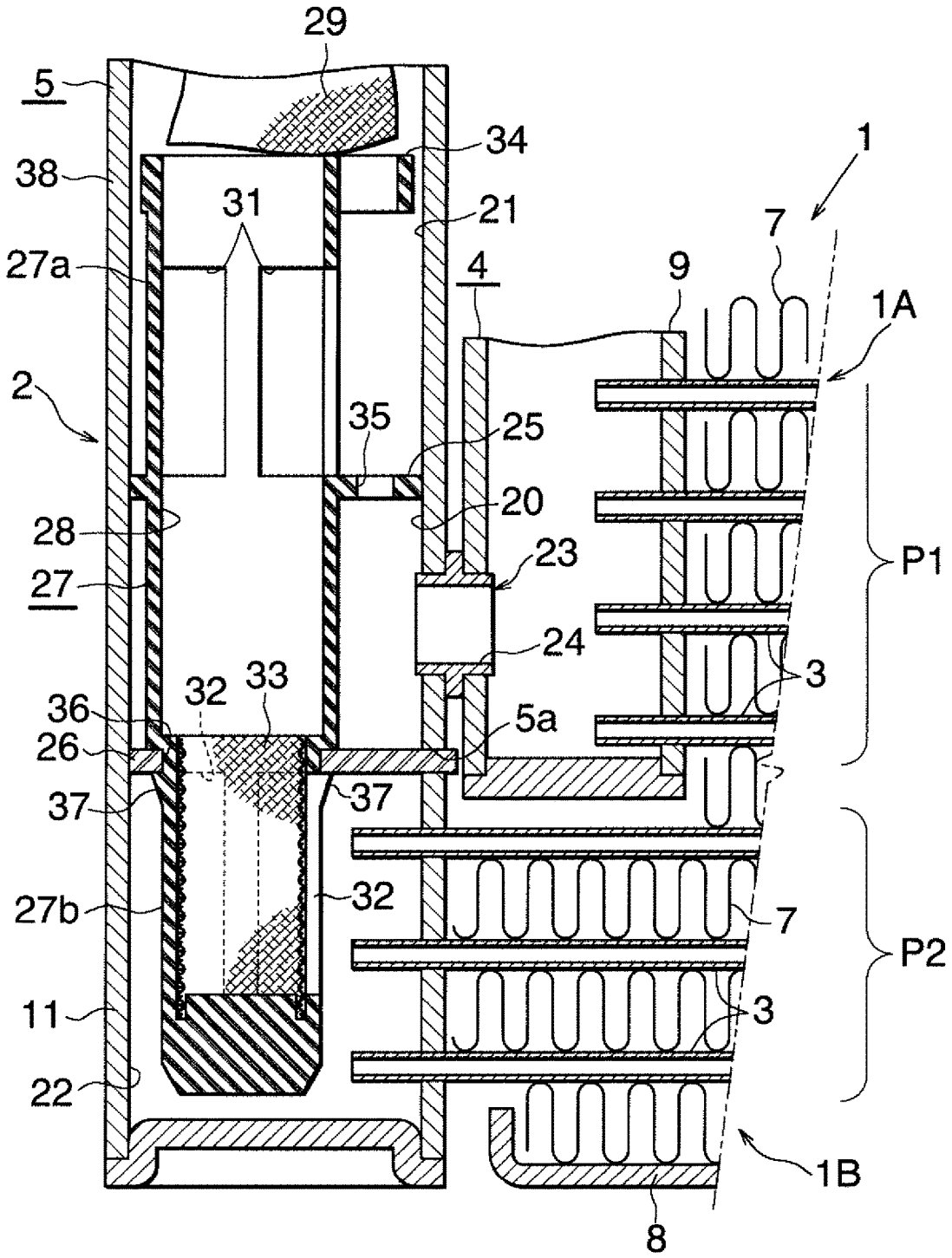
FIG. 4 is a sectional view taken along line B-B of FIG. 3.
Figure 5:
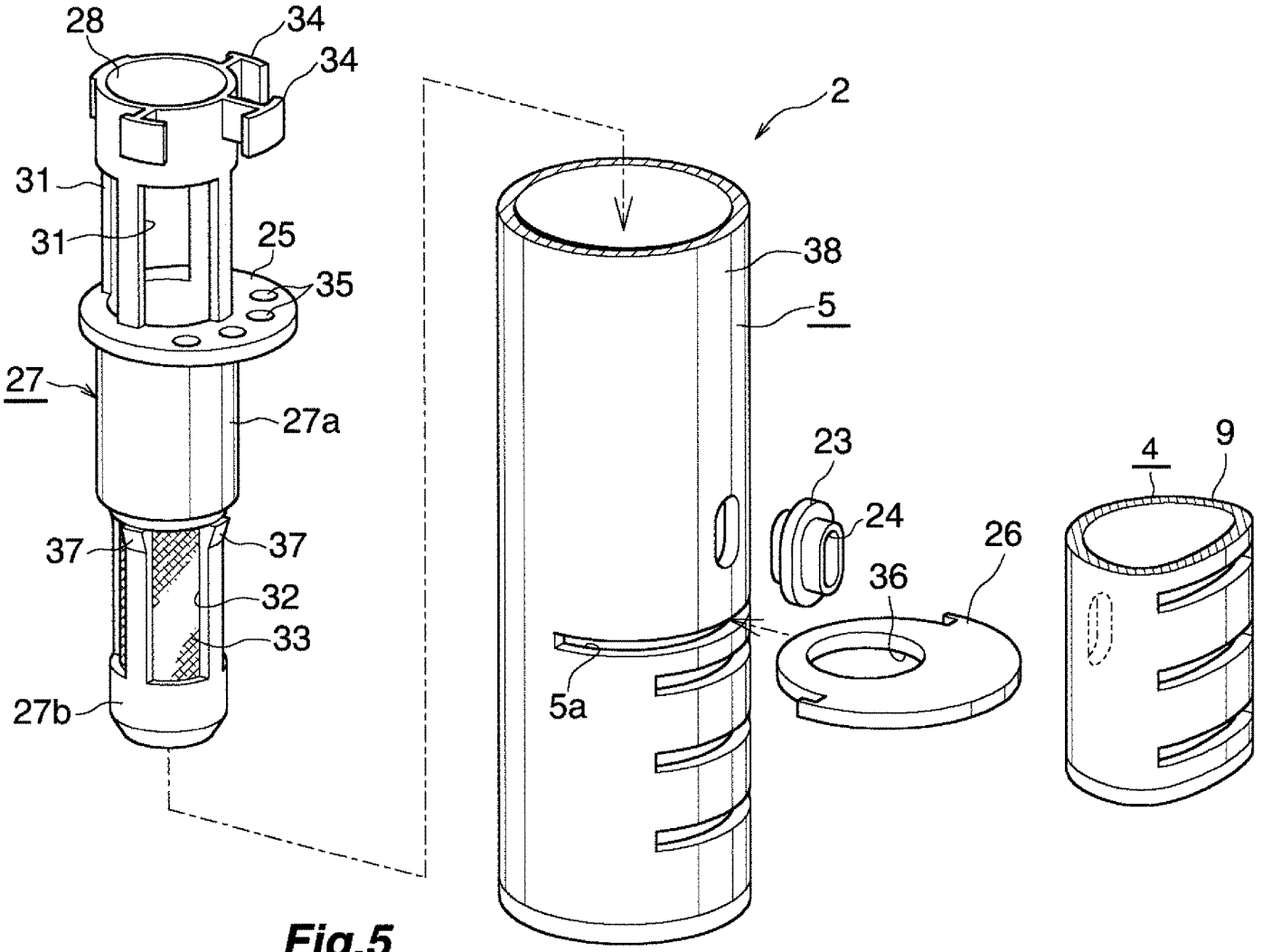
FIG. 5 is an exploded perspective view showing a refrigerant flow member and portions of first and second header tanks of the condenser shown in FIG. 1.
Figure 6:
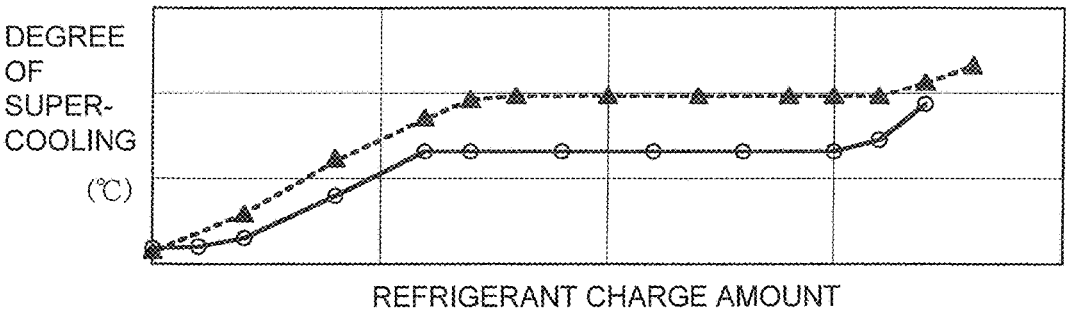
FIG. 6 is a charge graph showing the relation between refrigerant charge amount and degree of super-cooling in the condenser shown in FIG. 1.

FIG. 1 specifically shows the overall structure of a condenser according to a first embodiment of the present invention. FIG. 2 schematically shows the condenser of FIG. 1. FIGS. 3 through 5 show the structure of a main portion of the condenser of FIG. 1. In FIG. 2, individual heat exchange tubes are not illustrated, and corrugate fins, side plates, a refrigerant inlet member, and a refrigerant outlet member are also not illustrated.

In FIGS. 1 and 2, a condenser 1 has a condensation section 1A; a super-cooling section 1B provided below the condensation section 1A; and a liquid receiving section 2 provided between the condensation section 1A and the super-cooling section 1B. The liquid receiving section 2 is formed of a tubular member whose longitudinal direction coincides with the vertical direction and which is closed at the upper and lower ends thereof. The condenser 1 includes a plurality of flat heat exchange tubes 3 formed of aluminum, three header tanks 4, 5, 6 formed of aluminum, corrugate fins 7 formed of aluminum, and side plates 8 formed of aluminum. The heat exchange tubes 3 are disposed such that their width direction coincides with an air-passing direction (a direction perpendicular to the sheets on which FIG. 1 and FIG. 2 are drawn), their longitudinal direction coincides with the left-right direction, and they are spaced from one another in the vertical direction. The header tanks 4, 5, 6 are disposed such that their longitudinal direction coincides with the vertical direction, and left and right end portions of the heat exchange tubes 3 are brazed to the header tanks 4, 5, 6. Each of the corrugate fins 7 is disposed between and brazed to adjacent heat exchange tubes 3, or is disposed on the outer side of the uppermost or lowermost heat exchange tube 3 and brazed to the corresponding heat exchange tube 3. The side plates 8 are disposed on the corresponding outer sides of the uppermost and lowermost corrugate fins 7, and are brazed to these corrugate fins 7.

Each of the condensation section 1A and super-cooling section 1B of the condenser 1 includes at least one (only one in the present embodiment) heat exchange path P1, P2 formed by a plurality of heat exchange tubes 3 successively arranged in the vertical direction. The heat exchange path P1 provided in the condensation section 1A serves as a refrigerant condensation path. The heat exchange path P2 provided in the super-cooling section 1B serves as a refrigerant super-cooling path. The length of the heat exchange tubes 3 constituting the refrigerant super-cooling path is greater than the length of the heat exchange tubes 3 constituting the refrigerant condensation path. The flow direction of refrigerant is the same among all the heat exchange tubes 3 which form the respective heat exchange paths P1, P2. The flow direction of refrigerant in the heat exchange tubes 3 which form a certain heat exchange path is opposite the flow direction of refrigerant in the heat exchange tubes 3 which form another heat exchange path adjacent to the certain heat exchange path. The heat exchange path P1 of the condensation section 1A will be referred to as the first heat exchange path, and the heat exchange path P2 of the super-cooling section 1B will be referred to as the second heat exchange path. In the condenser 1, the refrigerant having flowed out of the heat exchange tubes 3 of the first heat exchange path P1 (the refrigerant condensation path at the lower end) flows into the heat exchange tubes 3 of the second heat exchange path P2 (the refrigerant super-cooling path at the upper end) through the liquid receiving section 2.

The first header tank 4 and the second header tank 5 are individually provided at the left end of the condenser 1 in such a manner that the second header tank 5 is located on the outer side of the first header tank 4 in the left-right direction. Left end portions of all the heat exchange tubes 3 which form the first heat exchange path P1 provided in the condensation section 1A are connected to the first header tank 4 by brazing. Left end portions of all the heat exchange tubes 3 which form the second heat exchange path P2 provided in the super-cooling section 1B are connected to the second header tank 5 by brazing. The lower end of the second header tank 5 is located below the lower end of the first header tank 4, and the upper end of the second header tank 5 is located above the lower end of the first header tank 4. All the heat exchange tubes 3 of the super-cooling section 1B; i.e., all the heat exchange tubes 3 of the second heat exchange path P2, are connected to a portion of the second header tank 5 located below the lower end of the first header tank 4. The second header tank 5 also functions as the liquid receiving section 2 which stores the refrigerant flowing from the condensation section 1A, separates it into gaseous and liquid phases, and supplies liquid phase predominant refrigerant to the super-cooling section 1B.

A single condensation section outlet header section 9 is provided over the entirety of the first header tank 4 separately from the liquid receiving section 2. A downstream end portion (in the refrigerant flow direction) of the first heat exchange path P1 (the lower-end heat exchange path of the condensation section 1A) communicates with the condensation section outlet header section 9. A super-cooling section inlet header section 11 is provided in a portion of the second header tank 5 located below the lower end of the first header tank 4. An upstream end portion (in the refrigerant flow direction) of the second heat exchange path P2 (the upper-end heat exchange path of the super-cooling section 1B) communicates with the super-cooling section inlet header section 11. Namely, the lower end of the liquid receiving section 2 (i.e., the second header tank 5) is located below the lower end of the condensation section outlet header section 9, and the upper end of the liquid receiving section 2 is located above the lower end of the condensation section outlet header section 9.

The third header tank 6 is disposed at the right end of the condenser 1. Right end portions of all the heat exchange tubes 3 which form the first and second heat exchange paths P1, P2 are connected to the third header tank 6 by brazing.

The interior of the third header tank 6 is divided into an upper section 6*a* and a lower section 6*b* by a plate-shaped partition member 12 formed of aluminum and provided at a height between the first heat exchange path P1 and the second heat exchange path P2. A single condensation section inlet header section 13 is provided in the upper section 6*a*. An upstream end portion (in the refrigerant flow direction) of the first heat exchange path P1 of the condensation section 1A communicates with the condensation section inlet header section 13. A super-cooling section outlet header section 14 is provided in the lower section 6*b*. A downstream end portion (in the refrigerant flow direction) of the second heat exchange path P2 of the super-cooling section 1B communicates with the super-cooling section outlet header section 14. The condensation section inlet header section 13 of the third header tank 6 has a refrigerant inlet 15 formed at an intermediate position in the vertical direction. The super-cooling section outlet header section 14 has a refrigerant outlet 16. A refrigerant inlet member 17 formed of aluminum and communicating with the refrigerant inlet 15 and a refrigerant outlet member 18 formed of aluminum and communicating with the refrigerant outlet 16 are joined to the third header tank 6.

As shown in FIGS. 3 through 5, a first space 20, a second space 21 located above the first space 20, and a third space 22 located below the first space 20 are provided within the second header tank 5, which serves as the liquid receiving section 2. The refrigerant flows from the heat exchange tubes 3 of the first heat exchange path P1 to the first space 20 through the condensation section outlet header section 9. The refrigerant flows from the first space 20 into the second space 21. The refrigerant flows from the second space 21 into the third space 22 and then flows to the heat exchange tubes 3 of the second heat exchange path P2. A throttle is provided in a region through which the refrigerant flows from the first space 20 into the second space 21. The first space 20 is provided in a region above the lower end of the condensation section outlet header section 9. The third space 22 also serves as the super-cooling section inlet header section 11.

A communication member 23 formed of aluminum is disposed between a portion of the interior of the condensation section outlet header section 9 of the first header tank 4 near the lower end thereof and a portion of the second header tank 5 whose vertical position corresponds to that of the first space 20 and is brazed to the two header tanks 4 and 5. The communication member 23 has a communication passage 24 for establishing communication between the condensation section outlet header section 9 and the first space 20. The communication passage 24 of the communication member 23 serves as a throttle for the refrigerant flowing from the condensation section outlet header section 9 into the first space 20. Preferably, the channel cross-sectional area of the communication passage 24 of the communication member 23 is equal to or less than the total channel cross-sectional area of all the heat exchange tubes 3 communicating with the condensation section outlet header section 9.

A first partition member 25, a second partition member 26, and a refrigerant flow member 27 are provided within the second header tank 5, which serves as the liquid receiving section 2. The first partition member 25 divides the interior of the second header tank 5 into the first space 20 and the second space 21. The second partition member 26 divides the interior of the second header tank 5 into the first space 20 and the third space 22. The refrigerant flow member 27 has a refrigerant passage channel 28 which establishes communication between the second space 21 and the third space 22. A bag-shaped desiccant container 29 formed of a material having gas permeability and liquid permeability is disposed within the second space 21. The second header tank 5 is composed of a cylindrical tubular tank main body 38 whose upper end is open and whose lower end is closed, and a closure member 39 which is removably attached to an upper end portion of the tank main body 38 so as to close the upper end opening of the tank main body 38.

The refrigerant flow member 27 is formed of synthetic resin and has a cylindrical tubular shape. The refrigerant flow member 27 is open at the upper end and closed at the lower end, and the interior of the refrigerant flow member 27 serves as the refrigerant passage channel 28. The upper end of the refrigerant flow member 27 is located above the first partition member 25 and is located above the lower end of the condensation section outlet header section 9 (within the second space 21), the lower end of the refrigerant flow member 27 is located below the second partition member 26 and is located in a lower end portion of the second header tank 5 (within the third space 22), and the refrigerant flow member 27 is disposed to extend through the first through third spaces 20, 21, and 22. A portion of the refrigerant flow member 27 located within the third space 22 has an outer diameter smaller than that of a portion of the refrigerant flow member 27 located within the first space 20 and the second space 21. The large diameter portion is denoted by 27*a*, and the small diameter portion is denoted by 27*b*. A plurality of first communication openings 31 for establishing communication between the refrigerant passage channel 28 and the second space 21 are formed in a portion of the large diameter portion 27*a* of the refrigerant flow member 27 located within the second space 21 in such a manner that the first communication openings 31 are spaced from one another in the circumferential direction. Similarly, a plurality of second communication openings 32 for establishing communication between the refrigerant passage channel 28 and the third space 22 are formed in the small diameter portion 27*b* of the refrigerant flow member 27 located within the third space 22 in such a manner that the second communication openings 32 are spaced from one another in the circumferential direction. Communication is not established between the first space 20 and the refrigerant passage channel 28 of the refrigerant flow member 27. The first communication openings 31 and/or the second communication openings 32 (in the present embodiment, the second communication openings 32) are closed by a mesh filter 33. The filter 33 may be formed integrally with the refrigerant flow member 27, or may be formed separately from the refrigerant flow member 27 and fixed to the refrigerant flow member 27. Also, a plurality of outward projecting portions 34 which project outward in the radial direction are integrally formed at the upper end of the refrigerant flow member 27 in such a manner that the outward projecting portions 34 are spaced from one another in the circumferential direction. The desiccant container 29 is supported by the outward projecting portions 34 and the upper end of the circumferential wall of the refrigerant flow member 27. As a result, the first communication openings 31 are prevented from being closed by the desiccant container 29.

The first partition member 25 is integrally formed on the outer circumferential surface of the refrigerant flow member 27, and its outer peripheral edge portion is in close contact with the inner circumferential surface of the second header tank 5. The first partition member 25 closes the gap between the inner circumferential surface of the second header tank 5 (the liquid receiving section 2) and the outer circumferential surface of the large diameter portion 27*a* of the refrigerant flow member 27. A plurality of refrigerant passage holes 35 for establishing communication between the first space 20 and the second space 21 are formed in the first partition member 25. The refrigerant passage holes 35 serve as throttles for the refrigerant flowing from the first space 20 into the second space 21.

The second partition member 26 is an aluminum plate fixed to the second header tank 5. The second partition member 26 is externally inserted into a slit 5*a* formed in the circumferential wall of the second header tank 5 and is brazed to the circumferential wall. The second partition member 26 has a circular through hole 36 formed at a position located outward of the center of the second partition member 26 in the left-right direction. The small diameter portion 27*b* of the refrigerant flow member 27 is tightly inserted into the through hole 36 from the upper side thereof. The second partition member 26 closes the gap between the inner circumferential surface of the second header tank 5 (the liquid receiving section 2) and the outer circumferential surface of the small diameter portion 27*b* of the refrigerant flow member 27. The second partition member 26 is sandwiched and held between the lower end of the large diameter portion 27*a* of the refrigerant flow member 27 and a plurality of protrusions 37 which are integrally formed on the outer circumferential surface of the small diameter portion 27*b* of the refrigerant flow member 27 at predetermined intervals in the circumferential direction and protrude radially outward. As a result, the movement of the refrigerant flow member 27 in the vertical direction is prevented.

The refrigerant flow member 27 having the first partition member 25 integrally formed therewith is inserted into the tank main body 38 of the second header tank 5 through its upper end opening after the members, excluding the refrigerant flow member 27, the desiccant container 29, and the closure member 39, are brazed together.

Notably, in the condenser 1 of the first embodiment shown in FIGS. 3 through 5, the first partition member 25 is integrally formed on the refrigerant flow member 27. However, the method of providing the first partition member 25 is not limited thereto. The first partition member 25 may be formed of an aluminum plate like the second partition member 26, and be externally inserted into a slit formed in the circumferential wall of the second header tank 5 and brazed to the circumferential wall. In this case, the first partition member 25 has a circular through hole formed at a position located outward of the center of the first partition member 25 in the left-right direction, and the refrigerant flow member 27 is tightly inserted into the through hole from the upper side thereof.

The condenser 1 constitutes a refrigeration cycle in cooperation with a compressor, an expansion valve (pressure reducer), and an evaporator; and the refrigeration cycle is mounted on a vehicle as a car air conditioner.

In the car air conditioner including the condenser 1 having the above-described structure, gas phase refrigerant of high temperature and high pressure compressed by the compressor flows into the condensation section inlet header section 13 of the third header tank 6 through the refrigerant inlet member 17 and the refrigerant inlet 15. The refrigerant flows leftward within the heat exchange tubes 3 of the first heat exchange path P1 and flows into the condensation section outlet header section 9 of the first header tank 4.

The refrigerant having flowed into the condensation section outlet header section 9 of the first header tank 4 passes through the communication passage 24 of the communication member 23, and horizontally flows into the first space 20 of the second header tank 5. At that time, the communication passage 24 of the communication member 23 functions as a throttle, and a pressure loss is generated when the refrigerant flows from the condensation section outlet header section 9 into the first space 20.

The refrigerant having flowed into the first space 20 of the second header tank 5 passes through the refrigerant passage holes 35 of the first partition member 25, and flows into the second space 21. As a result, the refrigerant is separated into gaseous and liquid phases within the second space 21, and the liquid phase refrigerant is stored in the second space 21. At that time, the refrigerant passage holes 35 serve as throttles, and a pressure loss is generated when the refrigerant flows from the first space 20 into the second space 21. Also, since the refrigerant flows upward from the first space 20 into the second space 21, the gas-liquid separation function in the second space 21 is improved.

The liquid phase refrigerant produced as a result of the gas-liquid separation within the second space 21 of the second header tank 5 and stored in the second space 21 flows into the refrigerant passage channel 28 through the first communication openings 31 of the refrigerant flow member 27, flows downward within the refrigerant passage channel 28, and flows into the super-cooling section inlet header section 11 (the third space 22) through the second communication openings 32 without flowing into the first space 20. The refrigerant having flowed into the super-cooling section inlet header section 11 enters the heat exchange tubes 3 of the second heat exchange path P2 and is super-cooled while flowing rightward within the heat exchange tubes 3. The super-cooled refrigerant enters the super-cooling section outlet header section 14 of the third header tank 6 and flows out through the refrigerant outlet 16 and the refrigerant outlet member 18. The refrigerant is then fed to the evaporator through the expansion valve.

In the above-described condenser 1, since a pressure loss is generated when the refrigerant flows from the condensation section outlet header section 9 into the first space 20 and when the refrigerant flows from the first space 20 into the second space 21, a clear difference in the pressure condition of the refrigerant is produced between the interior of the condensation section outlet header section 9 and the interior of the first space 20 and between the interior of the first space 20 and the interior of the second space 21. As a result, the state of the refrigerant in the first heat exchange path P1 communicating with the first space 20 can be made clearly different from the state of the refrigerant within the second space 21.

A predetermined amount of refrigerant was first charged into a car air conditioner including the condenser 1, the operation of the refrigeration cycle was started, and the degrees of super-cooling at various refrigerant charge amounts were investigated while adding the refrigerant, whereby a charge graph (see a continuous line in FIG. 6) was made. The degrees of super-cooling decreases as compared with a charge graph made through use of a car air conditioner including the condenser disclosed in the above-described publication (see a broken line in FIG. 6). Accordingly, the difference between the state of the refrigerant within the heat exchange tubes 3 which forms a lower portion of the first heat exchange path P1 and the state of the refrigerant within the second space 21 of the second header tank 5 (the liquid receiving section 2) which stores the liquid phase refrigerant resulting from the gas-liquid separation becomes clear, and the liquid phase refrigerant which has been condensed and super cooled is restrained from accumulating within the heat exchange tubes 3 of the first heat exchange path P1, which is the refrigerant condensation path, whereby the refrigerant within the condenser 1 becomes less likely to be influenced by changes in the external environment such as temperature and wind speed. As a result, even in the case where the size of the condenser 1 is reduced, the stability of the condensation performance of the condensation section 1A against changes in the external environment is improved effectively. Therefore, even under a special external environment condition, the condensation section 1A stably exhibits an expected refrigerant condensation performance.

In the condenser 1 of the first embodiment, the condensation section 1A may include a plurality of heat exchange paths which are juxtaposed in the vertical direction and each of which is composed of a plurality of heat exchange tubes 3 successively arranged in the vertical direction, and the super-cooling section 1B may include a plurality of heat exchange paths each of which is composed of a plurality of heat exchange tubes 3 successively arranged in the vertical direction. In the case where a plurality of heat exchange paths are provided in the condensation section 1A in such a manner that they are juxtaposed in the vertical direction, each of the interior of the first header tank 4 and the interior of the third header tank 6 is divided into a plurality of sections by a partition member(s) provided at a proper vertical position(s) in such a manner that the refrigerant successively from the heat exchange path at the upper end toward the heat exchange path at the lower end, and the section at the lower end of the first header tank 4 serves as the condensation section outlet header section. Also, in the case where a plurality of heat exchange paths are provided in the super-cooling section 1B in such a manner that they are juxtaposed in the vertical direction, each of the interior of the third space 22 of the second header tank 5 and the interior of the third header tank 6 is divided into a plurality of sections by a partition member(s) provided at a proper vertical position(s) in such a manner that the refrigerant successively from the heat exchange path at the upper end toward the heat exchange path at the lower end, and the section at the upper end of the second header tank 5 serves as the super-cooling section inlet header section.

Figure 7:
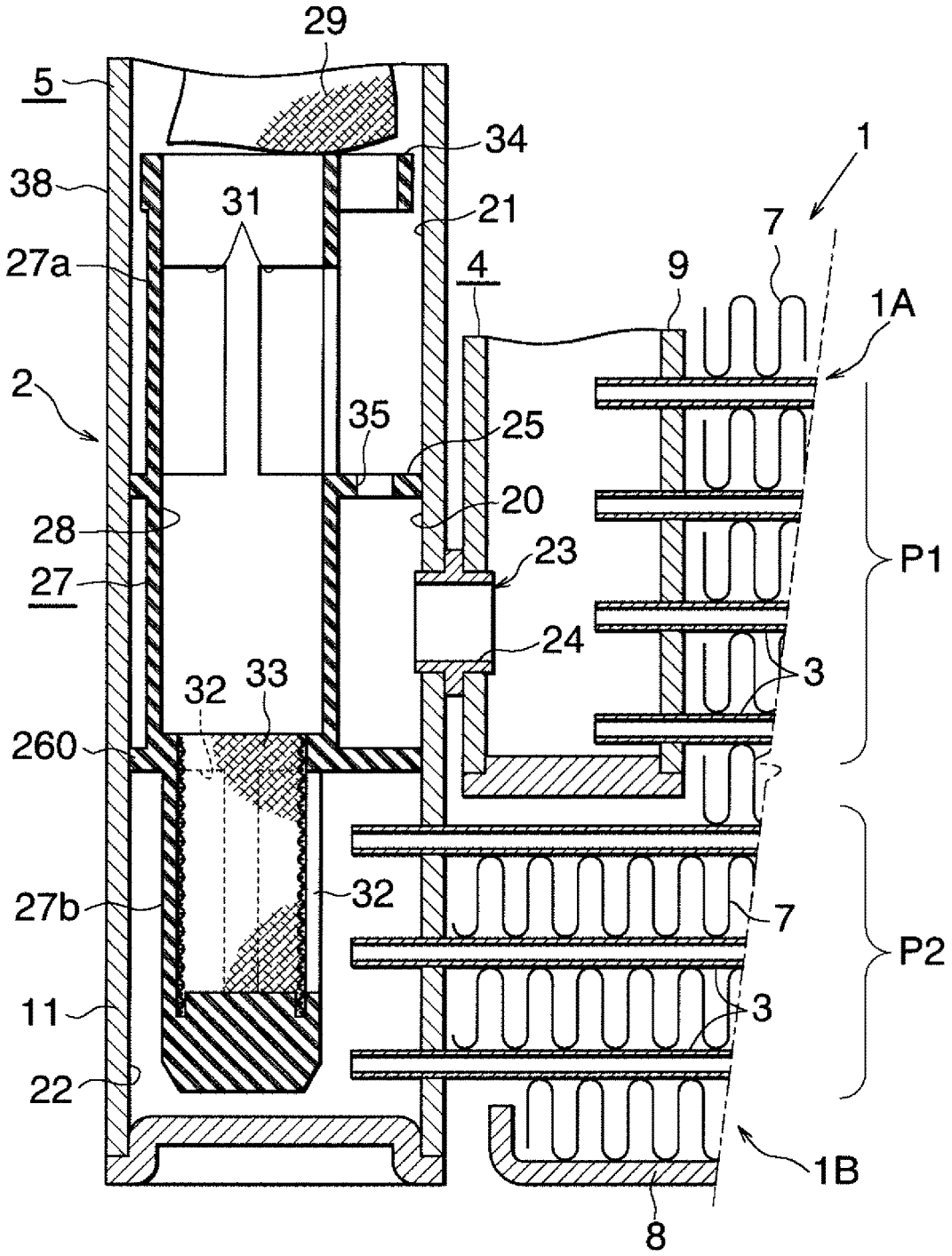
FIG. 7 is a view corresponding to FIG. 4 and showing a modification of a second partition member of the condenser of the first embodiment which divides the interior of a second header tank into first and third spaces.

FIG. 7 shows a modification of the second partition member of the condenser 1 of the first embodiment which divides the interior of the second header tank 5 into the first space 20 and the third space 22.

A second partition member 260 shown in FIG. 7 is integrally formed on the outer circumferential surface of the refrigerant flow member 27 (here, the outer circumferential surface of the upper end of the small diameter portion 27*b*), and its outer peripheral edge portion is in close contact with the inner circumferential surface of the second header tank 5. The second partition member 260 closes the gap between the inner circumferential surface of the second header tank 5 (the liquid receiving section 2) and the outer circumferential surface of the small diameter portion 27*b* of the refrigerant flow member 27. Notably, the second partition member 260 may be integrally formed on the outer circumferential surface of the large diameter portion 27*a* instead of integrally being formed on the outer circumferential surface of the small diameter portion 27*b*. Further, the refrigerant flow member 27 is not required to have the large diameter portion 27*a* and the small diameter portion 27*b*, and the entire outer circumferential surface of the refrigerant flow member 27 may have the same diameter. In the case where the entire outer circumferential surface of the refrigerant flow member 27 has the same diameter, the second partition member 260 is integrally formed on the outer circumferential surface of a proper portion of the refrigerant flow member 27, its outer peripheral edge portion is in close contact with the inner circumferential surface of the second header tank 5, and the second partition member 260 closes the gap between the inner circumferential surface of the second header tank 5 (the liquid receiving section 2) and the outer circumferential surface of the refrigerant flow member 27.

In the case where the second partition member 260 shown in FIG. 7 is used, the following effect is attained. Namely, the integral formation of the second partition member 260 on the refrigerant flow member 27, coupled with the integral formation of the first partition member 25 on the refrigerant flow member 27, reduces the number of components. Also, since a slit through which the second partition member is passed is not required to be formed in the second header tank 5, the number of machining steps decreases, whereby production cost decreases. In consideration of such an effect, in the case where the second partition member 260 is integrally formed on the refrigerant flow member 27, the integral formation of the first partition member 25 on the refrigerant flow member 27 is the best.

Notably, the integral formation of the second partition member 260 on the refrigerant flow member 27 presupposes that the heat exchange tubes 3 are not connected to a portion of the second header tank 5 located above the second partition member 260 and that the second header tank 5 is composed of the tank main body 38 and the closure member 39 removably attached to the upper end portion of the tank main body 38.

Second Embodiment

Figure 9:
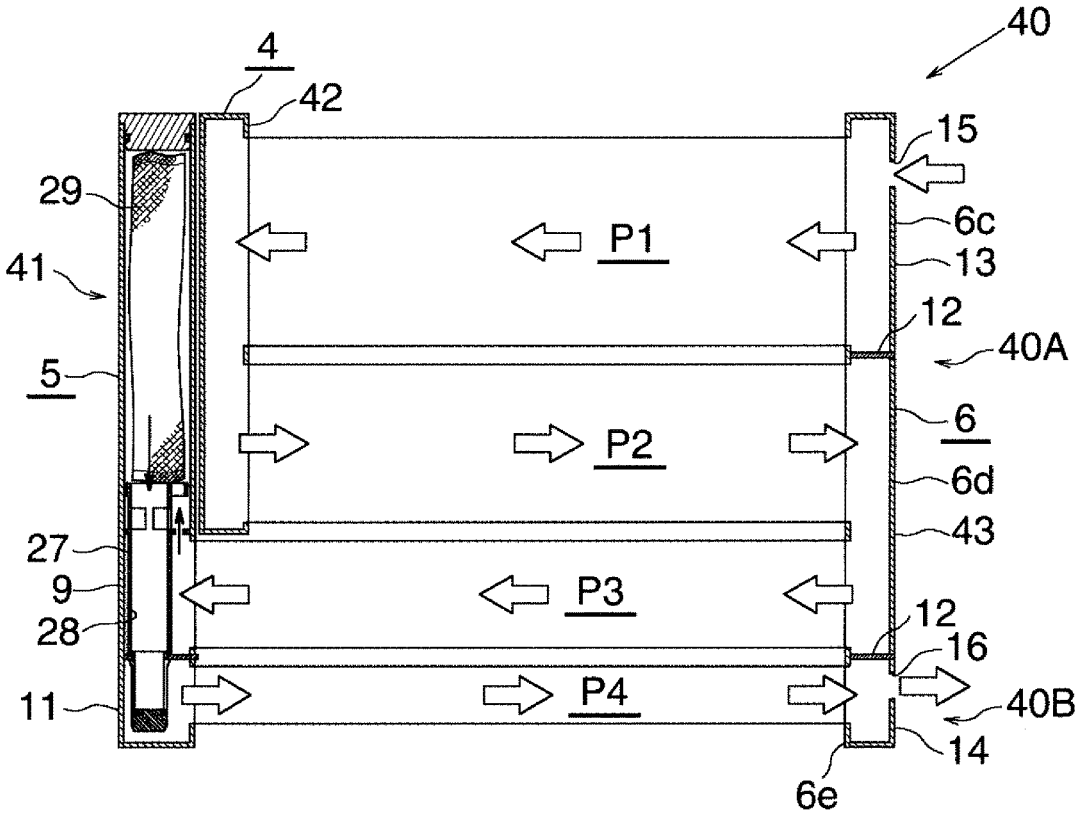
FIG. 9 is a front view schematically showing the condenser of FIG. 8.
Figure 10:
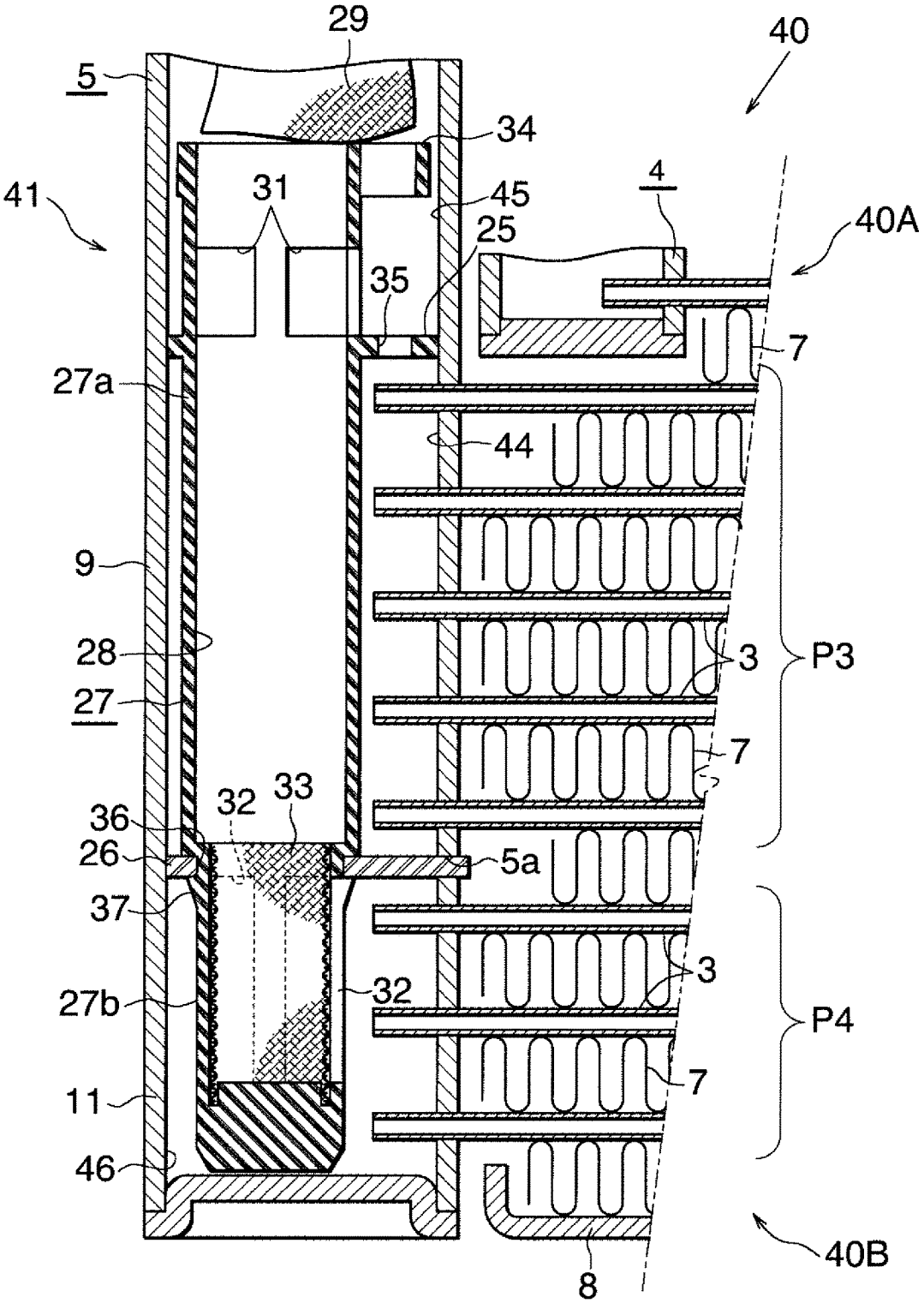
FIG. 10 is a view corresponding to FIG. 4 and showing a portion of the condenser shown in FIG. 8.

This embodiment is shown in FIGS. 8 through 10.

FIG. 8 specifically shows the overall structure of a condenser according to a second embodiment of the present invention. FIG. 9 schematically shows the condenser of FIG. 8. FIG. 10 shows the structure of a main portion of the condenser of FIG. 8. In FIG. 9, individual heat exchange tubes are not illustrated, and corrugate fins, side plates, a refrigerant inlet member, and a refrigerant outlet member are also not illustrated.

In FIGS. 8 and 9, a condenser 40 has a condensation section 40A; a super-cooling section 40B provided below the condensation section 40A; and a liquid receiving section 41 provided between the condensation section 40A and the super-cooling section 40B. The liquid receiving section 41 is composed of a tubular member whose longitudinal direction coincides with the vertical direction and which is closed at the upper and lower ends thereof.

The condensation section 40A of the condenser 40 includes at least two heat exchange paths (in the present embodiment, three heat exchange paths P1, P2, and P3) each formed by a plurality of heat exchange tubes 3 successively arranged in the vertical direction. The super-cooling section 40B of the condenser 40 includes at least one heat exchange path (in the present embodiment, one heat exchange path P4) formed by a plurality of heat exchange tubes 3 successively arranged in the vertical direction. The heat exchange paths P1, P2, and P3 provided in the condensation section 40A serve as refrigerant condensation paths. The heat exchange path P4 provided in the super-cooling section 40B serves as a refrigerant super-cooling path. The flow direction of refrigerant is the same among all the heat exchange tubes 3 which form each heat exchange path P1, P2, P3, or P4. The flow direction of refrigerant in the heat exchange tubes 3 which form a certain heat exchange path is opposite the flow direction of refrigerant in the heat exchange tubes 3 which form another heat exchange path adjacent to the certain heat exchange path. All the heat exchange paths P1, P2, P3, and P4 will be referred to as the first through fourth exchange paths, respectively. The refrigerant having flowed out of the heat exchange tubes 3 of the third heat exchange path P3 (the refrigerant condensation path at the lower end) flows into the heat exchange tubes 3 of the fourth heat exchange path P4 (the refrigerant super-cooling path at the upper end) through the liquid receiving section 41.

Left end portions of all the heat exchange tubes 3 which form the first and second heat exchange paths P1 and P2 provided in the condensation section 40A (the heat exchange tubes of the condensation section 40A excluding the heat exchange tubes of the lower-end refrigerant condensation path) are connected, by brazing, to the first header tank 4 disposed on the left end of the condenser 40. Similarly, left end portions of all the heat exchange tubes 3 which form the third and fourth heat exchange paths P3 and P4 (the heat exchange tubes of the lower-end refrigerant condensation path of the condensation section 40A and all the heat exchange tubes of the super-cooling section 40B) are connected, by brazing, to a portion of the second header tank 5 located below the lower end of the first header tank 4. The second header tank 5 also functions as the liquid receiving section 41 which stores the refrigerant flowing from the condensation section 40A, separates it into gaseous and liquid phases, and supplies liquid phase predominant refrigerant to the super-cooling section 40B.

A first intermediate header section 42 is provided over the entirety of the first header tank 4. A downstream end portion (in the refrigerant flow direction) of the first heat exchange path P1 and an upstream end portion (in the refrigerant flow direction) of the second heat exchange path P2 communicate with the first intermediate header section 42.

The condensation section outlet header section 9 and the super-cooling section inlet header section 11 are provided in a portion of the second header tank 5 located below the lower end of the first header tank 4 such that the former is located above the latter. A downstream end portion (in the refrigerant flow direction) of the third heat exchange path P3 (the lower-end heat exchange path of the condensation section 40A) communicates with the condensation section outlet header section 9. An upstream end portion (in the refrigerant flow direction) of the fourth heat exchange path P4 (the upper-end heat exchange path of the super-cooling section 40B) communicates with the super-cooling section inlet header section 11.

The interior of the third header tank 6 disposed at the right end of the condenser 40 is divided into an upper section 6*c*, an intermediate section 6*d*, and a lower section 6*e* by plate-shaped partition members 12 formed of aluminum and provided at a height between the first heat exchange path P1 and the second heat exchange path P2 and at a height between the third heat exchange path P3 and the fourth heat exchange path P4, respectively. The condensation section inlet header section 13 is provided in the upper section 6*c*. An upstream end portion (in the refrigerant flow direction) of the first heat exchange path P1 of the condensation section 40A communicates with the condensation section inlet header section 13. A second intermediate header section 43 is provided in the intermediate section 6*d*. A downstream end portion (in the refrigerant flow direction) of the second heat exchange path P2 and an upstream end portion (in the refrigerant flow direction) of the third heat exchange path P3 communicate with the second intermediate header section 43. The super-cooling section outlet header section 14 is provided in the lower section 6*e*. A downstream end portion (in the refrigerant flow direction) of the fourth heat exchange path P4 of the super-cooling section 40B communicates with the super-cooling section outlet header section 14.

As shown in FIG. 10, a first space 44, a second space 45 located above the first space 44, and a third space 46 located below the first space 44 are provided within the second header tank 5, which serves as the liquid receiving section 41. The refrigerant flows from the heat exchange tubes 3 of the third heat exchange path P3 into the first space 44. The refrigerant flows from the first space 44 into the second space 45. The refrigerant flows from the second space 45 into the third space 46 and then flows to the heat exchange tubes 3 of the fourth exchange path P4 (the upper-end refrigerant super-cooling path). A throttle is provided in a region through which the refrigerant flows from the first space 44 into the second space 45.

The first space 44 is provided in a portion of the second header tank 5 to which the heat exchange tubes 3 of the third heat exchange path P3 are connected. The third space 46 is provided in a portion of the second header tank 5 to which the heat exchange tubes 3 of the fourth heat exchange path P4 are connected. The first space 44 also serves as the condensation section inlet header section 9, and the third space 46 also serves as the super-cooling section inlet header section 11.

The first partition member 25, the second partition member 26, and the refrigerant flow member 27 are provided within the second header tank 5, which serves as the liquid receiving section 41. The first partition member 25 divides the interior of the second header tank 5 into the first space 44 and the second space 45. The second partition member 26 divides the interior of the second header tank 5 into the first space 44 and the third space 46. The refrigerant flow member 27 has the refrigerant passage channel 28 which establishes communication between the second space 45 and the third space 46.

The upper end of the refrigerant flow member 27 disposed within the second header tank 5 is located above the first partition member 25 (within the second space 45), the lower end of the refrigerant flow member 27 is located below the second partition member 26 and is located in a lower end portion of the second header tank 5 (within the third space 46), and the refrigerant flow member 27 is disposed to extend through the first through third spaces 44, 45, and 46. The plurality of first communication openings 31 for establishing communication between the refrigerant passage channel 28 and the second space 45 are formed in a portion of the refrigerant flow member 27 located within the second space 45 in such a manner that the first communication openings 31 are spaced from one another in the circumferential direction. Similarly, the plurality of second communication openings 32 for establishing communication between the refrigerant passage channel 28 and the third space 46 are formed in a portion of the refrigerant flow member 27 located within the third space 46 in such a manner that the second communication openings 32 are spaced from one another in the circumferential direction. Communication is not established between the first space 44 and the refrigerant passage channel 28 of the refrigerant flow member 27.

In the case of the condenser 40 of the second embodiment shown in FIGS. 8 through 10 as well, the first partition member 25 is integrally formed on the refrigerant flow member 27. However, the method of providing the first partition member 25 is not limited thereto. The first partition member 25 may be formed of an aluminum plate like the second partition member 26, and be externally inserted into a slit formed in the circumferential wall of the second header tank 5 and brazed to the circumferential wall. In this case, the first partition member 25 has a circular through hole formed at a position located outward of the center of the first partition member 25 in the left-right direction, and the refrigerant flow member 27 is tightly inserted into the through hole from the upper side thereof.

The condenser 40 constitutes a refrigeration cycle in cooperation with a compressor, an expansion valve (pressure reducer), and an evaporator; and the refrigeration cycle is mounted on a vehicle as a car air conditioner.

In the car air conditioner including the condenser 40 having the above-described structure, gas phase refrigerant of high temperature and high pressure compressed by the compressor flows into the condensation section inlet header section 13 of the third header tank 6 through the refrigerant inlet member 17 and the refrigerant inlet 15. The refrigerant flows leftward within the heat exchange tubes 3 of the first heat exchange path P1 and flows into the first intermediate header section 42 of the first header tank 4. The refrigerant having flowed into the first intermediate header section 42 flows rightward within the heat exchange tubes 3 of the second heat exchange path P2 and flows into the second intermediate header section 43 of the third header tank 6. The refrigerant further flows leftward within the heat exchange tubes 3 of the third heat exchange path P3 and flows into the condensation section outlet header section 9, which is the first space 44 of the first header tank 4.

The refrigerant having flowed into the condensation section outlet header section 9, which is the first space 44 of the first header tank 4, passes through the refrigerant passage holes 35 of the first partition member 25, and flows into the second space 45. As a result, the refrigerant is separated into gaseous and liquid phases within the second space 45, and the liquid phase refrigerant is stored in the second space 45. At that time, the refrigerant passage holes 35 serve as throttles, and a pressure loss is generated when the refrigerant flows from the first space 44 into the second space 45. Also, since the refrigerant flows upward from the first space 44 into the second space 45, the gas-liquid separation function in the second space 45 is improved.

The liquid phase refrigerant produced as a result of the gas-liquid separation within the second space 45 of the second header tank 5 and stored in the second space 45 flows into the refrigerant passage channel 28 through the first communication openings 31 of the refrigerant flow member 27, flows downward within the refrigerant passage channel 28, and flows into the super-cooling section inlet header section 11 (the third space 46) through the second communication openings 32 without flowing into the first space 44. The refrigerant having flowed into the super-cooling section inlet header section 11 enters the heat exchange tubes 3 of the fourth heat exchange path P4 and is super-cooled while flowing rightward within the heat exchange tubes 3. The super-cooled refrigerant enters the super-cooling section outlet header section 14 of the third header tank 6 and flows out through the refrigerant outlet 16 and the refrigerant outlet member 18. The refrigerant is then fed to the evaporator through the expansion valve.

In the above-described condenser 40, since a pressure loss is generated when the refrigerant flows from the first space 44 into the second space 45, a clear difference in the pressure condition of the refrigerant is produced between the interior of the first space 44 and the interior of the second space 45. As a result, the state of the refrigerant in the third heat exchange path P3 communicating with the first space 44 can be made clearly different from the state of the refrigerant within the second space 45. Accordingly, as in the case of the condenser 1 of the first embodiment, the difference between the state of the refrigerant within the heat exchange tubes 3 which forms a lower portion of the third heat exchange path P3 and the state of the refrigerant within the second space 45 of the second header tank 5 (the liquid receiving section 41) becomes clear, and the liquid phase refrigerant which has been condensed and super cooled is restrained from accumulating within the heat exchange tubes 3 of the third heat exchange path P3, which is the refrigerant condensation path at the lower end, whereby the refrigerant within the condenser 40 becomes less likely to be influenced by changes in the external environment such as temperature and wind speed. As a result, even in the case where the size of the condenser 40 is reduced, the stability of the condensation performance of the condensation section 40A against changes in the external environment is improved effectively. Therefore, even under a special external environment condition, the condensation section 40A stably exhibits an expected refrigerant condensation performance.

Third Embodiment

Figure 12:
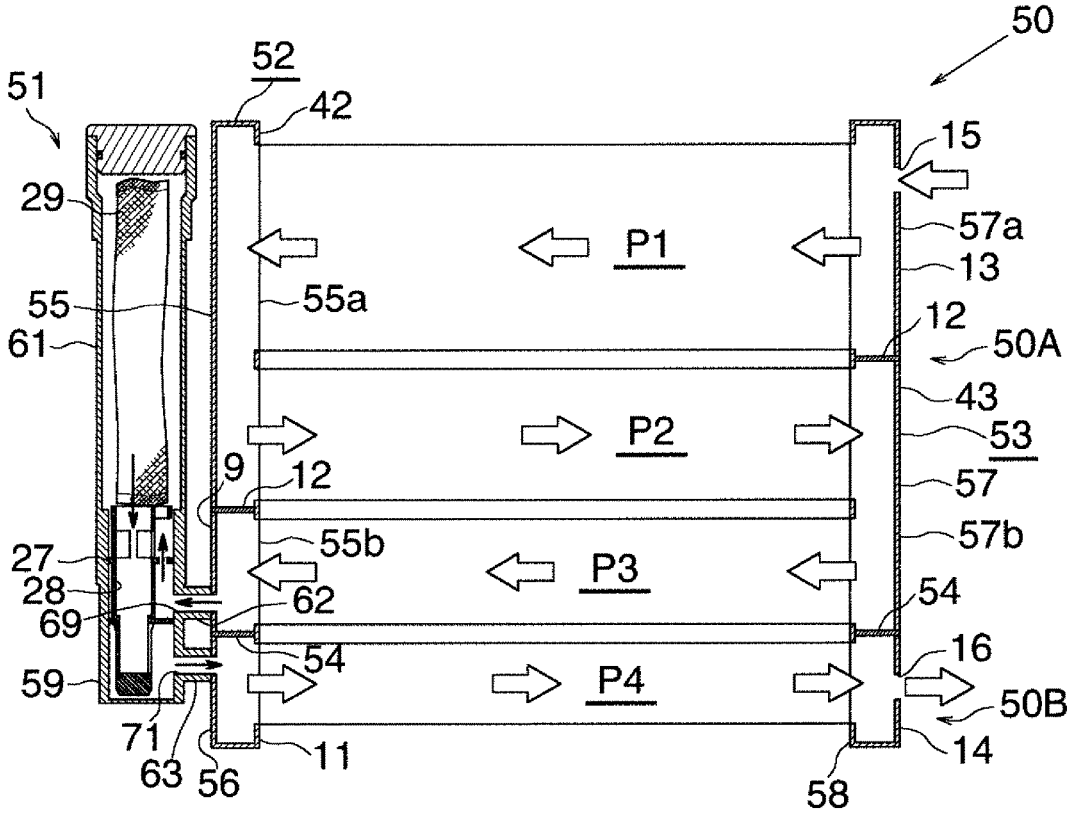
FIG. 12 is a front view schematically showing the condenser of FIG. 11.
Figure 13:
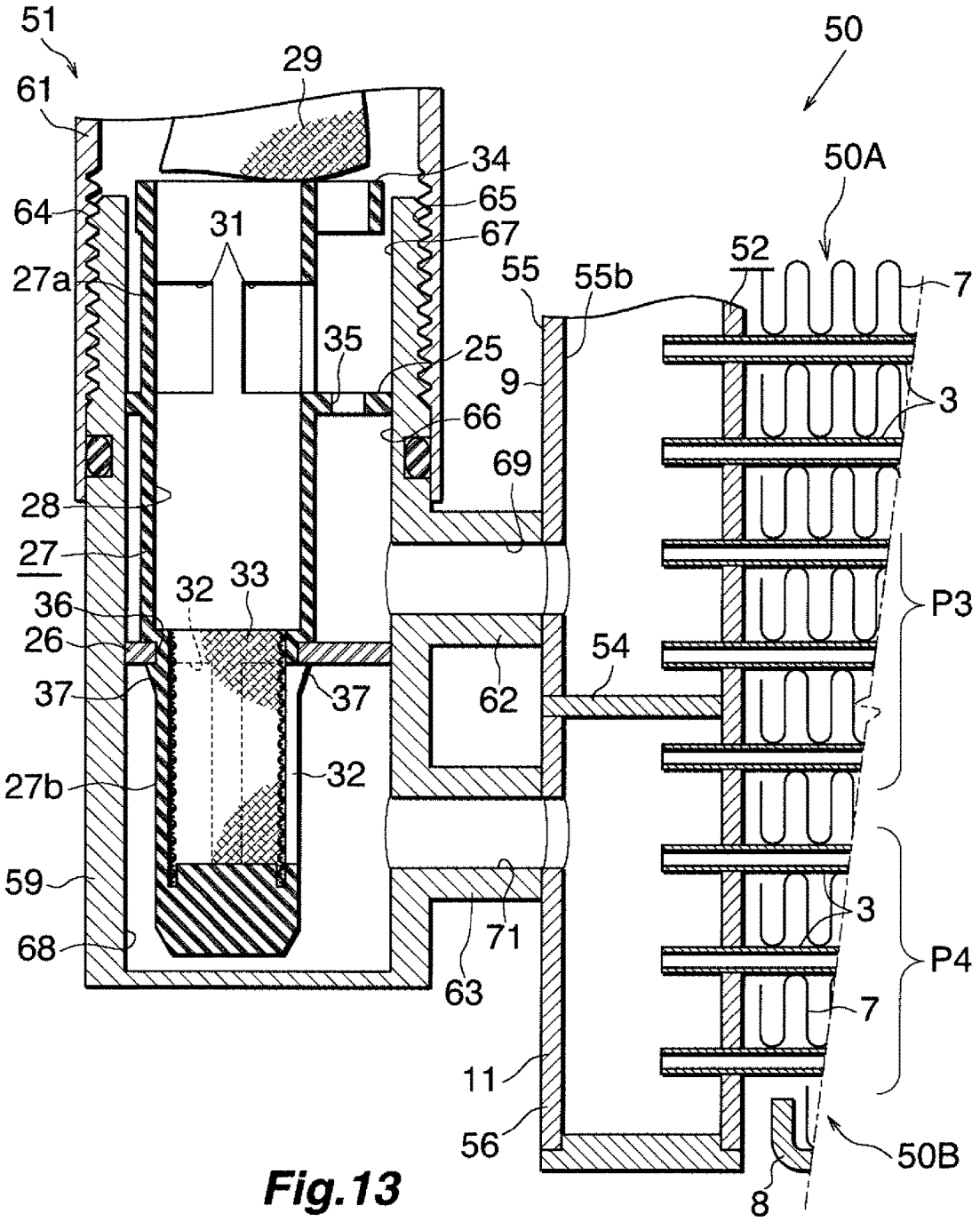
FIG. 13 is a view corresponding to FIG. 4 and showing a portion of the condenser shown in FIG. 11.

This embodiment is shown in FIGS. 11 through 13.

FIG. 11 specifically shows the overall structure of a condenser according to a third embodiment of the present invention. FIG. 12 schematically shows the condenser of FIG. 11. FIG. 13 shows the structure of a main portion of the condenser of FIG. 11. In FIG. 12, individual heat exchange tubes are not illustrated, and corrugate fins, side plates, a refrigerant inlet member, and a refrigerant outlet member are also not illustrated.

In FIGS. 11 and 12, a condenser 50 has a condensation section 50A; a super-cooling section 50B provided below the condensation section 50A; and a liquid receiving tank 51 (liquid receiving section) provided separately from the condensation section 50A and the super-cooling section 50B to located between the condensation section 50A and the super-cooling section 50B. The liquid receiving tank 51 is composed of a tubular member whose longitudinal direction coincides with the vertical direction and which is closed at the upper and lower ends thereof.

The condensation section 50A of the condenser 50 includes at least one heat exchange path (in the present embodiment, three heat exchange paths P1, P2, and P3) formed by a plurality of heat exchange tubes 3 successively arranged in the vertical direction. The super-cooling section 50B of the condenser 50 includes at least one heat exchange path (in the present embodiment, one heat exchange path P4) formed by a plurality of heat exchange tubes 3 successively arranged in the vertical direction. The heat exchange paths P1, P2, and P3 provided in the condensation section 50A serve as refrigerant condensation paths. The heat exchange path P4 provided in the super-cooling section 50B serves as a refrigerant super-cooling path. The flow direction of refrigerant is the same among all the heat exchange tubes 3 which form each heat exchange path P1, P2, P3, or P4. The flow direction of refrigerant in the heat exchange tubes 3 which form a certain heat exchange path is opposite the flow direction of refrigerant in the heat exchange tubes 3 which form another heat exchange path adjacent to the certain heat exchange path. All the heat exchange paths P1, P2, P3, and P4 will be referred to as the first through fourth exchange paths, respectively. The refrigerant having flowed out of the heat exchange tubes 3 of the third heat exchange path P3 (the refrigerant condensation path at the lower end) flows into the heat exchange tubes 3 of the fourth heat exchange path P4 (the refrigerant super-cooling path at the upper end) through the liquid receiving tank 51.

A left header tank 52 formed of aluminum and the liquid receiving tank 51 formed separately from the left header tank 52 are disposed at the left end of the condenser 50 in such a manner that the liquid receiving tank 51 is located on the outer side of the left header tank 52 in the left-right direction. Left end portions of all the heat exchange tubes 3 of the first through fourth heat exchange paths P1, P2, P3, and P4 are connected to the left header tank 52 by brazing. A right header tank 53 formed of aluminum is disposed at the right end of the condenser 50. Right end portions of all the heat exchange tubes 3 of the first through fourth heat exchange paths P1, P2, P3, and P4 are connected to the right header tank 53 by brazing. The interior of the left header tank 52 is divided into upper and lower tank portions 55 and 56 by a plate-shaped partition member 54 formed of aluminum and provided at a height between the third heat exchange path P3 and the fourth heat exchange path P4. Similarly, the interior of the right header tank 53 is divided into upper and lower tank portions 57 and 58 by another plate-shaped partition member 54 formed of aluminum and provided at a height between the third heat exchange path P3 and the fourth heat exchange path P4. The heat exchange tubes 3 of the first through third heat exchange paths P1, P2, and P3 are connected to the upper tank portions 55 and 57 of the two header tanks 52 and 53, and the heat exchange tubes 3 of the fourth heat exchange path P4 are connected to the lower tank portions 56 and 58 of the two header tanks 52 and 53.

The interior of the upper tank portion 55 of the left header tank 52 is divided into upper and lower sections 55*a* and 55*b* by a plate-shaped partition member 12 formed of aluminum and provided at a height between the second heat exchange path P2 and the third heat exchange path P3. The first intermediate header section 42 is provided in the upper section 55*a*. A downstream end portion (in the refrigerant flow direction) of the first heat exchange path P1 and an upstream end portion (in the refrigerant flow direction) of the second heat exchange path P2 communicate with the first intermediate header section 42. The condensation section outlet header section 9 is provided in the lower section 55*b*. A downstream end portion (in the refrigerant flow direction) of the third heat exchange path P3 (the lower-end heat exchange path of the condensation section 50A) communicates with the condensation section outlet header section 9. The super-cooling section inlet header section 11 is provided over the entirety of the lower tank portion 56 of the left header tank 52. An upstream end portion (in the refrigerant flow direction) of the fourth heat exchange path P4 (the upper-end heat exchange path of the super-cooling section 50B) communicates with the super-cooling section inlet header section 11.

The interior of the upper tank portion 57 of the right header tank 53 is divided into upper and lower sections 57*a* and 57*b* by another plate-shaped partition member 12 formed of aluminum and provided at a height between the first heat exchange path P1 and the second heat exchange path P2. The condensation section inlet header section 13 is provided in the upper section 57*a*. An upstream end portion (in the refrigerant flow direction) of the first heat exchange path P1 of the condensation section 50A communicates with the condensation section inlet header section 13. The second intermediate header section 43 is provided in the lower section 57*b*. A downstream end portion (in the refrigerant flow direction) of the second heat exchange path P2 of the condensation section 50A and an upstream end portion (in the refrigerant flow direction) of the third heat exchange path P3 communicate with the second intermediate header section 43. The super-cooling section outlet header section 14 is provided over the entirety of the lower tank portion 58 of the right header tank 53. A downstream end portion (in the refrigerant flow direction) of the fourth heat exchange path P4 communicates with the super-cooling section outlet header section 14. The refrigerant inlet 15 is formed in an upper portion of the condensation section inlet header section 13 of the right header tank 53, and the refrigerant outlet 16 is formed in the super-cooling section outlet header section 14. Also, the refrigerant inlet member 17 communicating with the refrigerant inlet 15 and the refrigerant outlet member 18 communicating with the refrigerant outlet 16 are joined to the right header tank 53.

The liquid receiving tank 51 is composed of a base member 59 formed of aluminum and fixed to a lower portion of the left header tank 52 by brazing or the like, and a liquid receiving tank main body 61 formed of aluminum and removably attached to the base member 59. The liquid receiving tank main body 61 has the shape of a cylindrical tube which is closed at the upper end and is open at the lower end. The upper end of the liquid receiving tank 51 is located above the lower end of the condensation section outlet header section 9, and the lower end of the liquid receiving tank 51 is located below the lower end of the condensation section outlet header section 9.

As shown in FIG. 13, the base member 59 of the liquid receiving tank 51 has the shape of a cylindrical tube which is closed at the lower end and is open at the upper end. Communication members 62 and 63 are integrally formed in such a manner that they project rightward from portions of the base member 59 which correspond to a lower portion of the condensation section outlet header section 9 of the left header tank 52 and an upper portion of the super-cooling section inlet header section 11 of the left header tank 52, respectively. The distal ends of the upper and lower communication members 62 and 63 are brazed to the circumferential wall of the left header tank 52.

An external thread 64 is formed on the outer circumferential surface of an upper portion of the base member 59, and an internal thread 65 to be engaged with the external thread 64 of the base member 59 is formed on the inner circumferential surface of a lower end portion of the liquid receiving tank main body 61. As a result of the lower end portion of the liquid receiving tank main body 61 being screwed onto the upper end portion of the base member 59, the liquid receiving tank main body 61 is removably attached to the base member 59, whereby the lower end opening of the liquid receiving tank main body 61 is closed by the base member 59.

A first space 66, a second space 67 located above the first space 66, and a third space 68 located below the first space 66 are provided within the liquid receiving tank 51. The refrigerant flows from the heat exchange tubes 3 of the third heat exchange path P3 into the first space 66 through the condensation section outlet header section 9. The refrigerant flows from the first space 66 into the second space 67. The refrigerant flows from the second space 67 into the third space 68 and then flows to the heat exchange tubes 3 of the fourth exchange path P4. A throttle is provided in a region through which the refrigerant flows from the first space 66 into the second space 67. The first space 66 is provided to be located above the lower end of the condensation section outlet header section 9.

A communication passage 69 for establishing communication between the condensation section outlet header section 9 of the left header tank 52 and the first space 66 of the liquid receiving tank 51 is formed in the upper communication member 62 of the base member 59 of the liquid receiving tank 51. A communication passage 71 for establishing communication between the super-cooling section inlet header section 11 of the left header tank 52 and the third space 68 of the liquid receiving tank 51 is formed in the lower communication member 63 of the base member 59. The communication passage 69 of the upper communication member 62 serves as a throttle for the refrigerant flowing from the condensation section outlet header section 9 into the first space 66. Preferably, the channel cross-sectional area of the communication passage 69 of the upper communication member 62 is equal to or less than the total channel cross-sectional area of all the heat exchange tubes 3 of the third heat exchange path P3 communicating with the condensation section outlet header section 9.

The first partition member 25, the second partition member 26, and the refrigerant flow member 27 are provided within the liquid receiving tank 51. The first partition member 25 divides the interior of the liquid receiving tank 51 into the first space 66 and the second space 67. The second partition member 26 divides the interior of the liquid receiving tank 51 into the first space 66 and the third space 68. The refrigerant flow member 27 has the refrigerant passage channel 28 which establishes communication between the second space 67 and the third space 68.

The upper end of the refrigerant flow member 27 disposed within the liquid receiving tank 51 is located above the first partition member 25 (within the second space 67), and the lower end of the refrigerant flow member 27 is located below the second partition member 26 and is located in a lower end portion of the liquid receiving tank 51 (within the third space 68). The refrigerant flow member 27 is disposed to extend through the first through third spaces 66, 67, and 68. The plurality of first communication openings 31 for establishing communication between the refrigerant passage channel 28 and the second space 67 are formed in a portion of the refrigerant flow member 27 located within the second space 67 in such a manner that the first communication openings 31 are spaced from one another in the circumferential direction. Similarly, the plurality of second communication openings 32 for establishing communication between the refrigerant passage channel 28 and the third space 68 are formed in a portion of the refrigerant flow member 27 located within the third space 68 in such a manner that the second communication openings 32 are spaced from one another in the circumferential direction. Communication is not established between the first space 66 and the refrigerant passage channel 28 of the refrigerant flow member 27.

The refrigerant flow member 27 having the first partition member 25 integrally formed therewith is disposed in the base member 59 after the members, excluding the refrigerant flow member 27, the desiccant container 29, and the liquid receiving tank 51, are brazed together.

In the case of the condenser 50 of the third embodiment shown in FIGS. 11 through 13 as well, the first partition member 25 is integrally formed on the refrigerant flow member 27. However, the method of providing the first partition member 25 is not limited thereto. The first partition member 25 may be formed of an aluminum plate like the second partition member 26, and be brazed to the circumferential wall of the base member 59 of the liquid receiving tank 51. In this case, the first partition member 25 has a circular through hole formed at a position located outward of the center of the first partition member 25 in the left-right direction, and the refrigerant flow member 27 is tightly inserted into the through hole from the upper side thereof.

The condenser 50 constitutes a refrigeration cycle in cooperation with a compressor, an expansion valve (pressure reducer), and an evaporator; and the refrigeration cycle is mounted on a vehicle as a car air conditioner.

In the car air conditioner including the condenser 50 having the above-described structure, gas phase refrigerant of high temperature and high pressure compressed by the compressor flows into the condensation section inlet header section 13 of the right header tank 53 through the refrigerant inlet member 17 and the refrigerant inlet 15. The refrigerant flows leftward within the heat exchange tubes 3 of the first heat exchange path P1 and flows into the first intermediate header section 42 of the left header tank 52. The refrigerant having flowed into the first intermediate header section 42 flows rightward within the heat exchange tubes 3 of the second heat exchange path P2 and flows into the second intermediate header section 43 of the right header tank 53. The refrigerant further flows leftward within the heat exchange tubes 3 of the third heat exchange path P3 and flows into the condensation section outlet header section 9 of the left header tank 52.

The refrigerant having flowed into the condensation section outlet header section 9 of the left header tank 52 passes through the communication passage 69 of the upper communication member 62 of the base member 59 and horizontally flows into the first space 66 of the liquid receiving tank 51. At that time, the communication passage 69 functions as a throttle, and a pressure loss is generated when the refrigerant flows from the condensation section outlet header section 9 into the first space 66.

The refrigerant having flowed into the first space 66 of the liquid receiving tank 51 passes through the refrigerant passage holes 35 of the first partition member 25 and flows into the second space 67. The refrigerant is separated into gaseous and liquid phases within the second space 67, and the liquid phase refrigerant is stored in the second space 67. At that time, the refrigerant passage holes 35 serve as throttles, and a pressure loss is generated when the refrigerant flows from the first space 66 into the second space 67. Also, since the refrigerant flows upward from the first space 66 into the second space 67, the gas-liquid separation function in the second space 67 is improved.

The liquid phase refrigerant produced as a result of the gas-liquid separation within the second space 67 of the liquid receiving tank 51 and stored in the second space 67 flows into the refrigerant passage channel 28 through the first communication openings 31 of the refrigerant flow member 27, flows downward within the refrigerant passage channel 28, and flows into the third space 68 through the second communication openings 32 without flowing into the first space 66. The refrigerant having flowed into the third space 68 passes through the communication passage 71 of the lower communication member 63 of the base member 59 and enters the super-cooling section inlet header section 11 of the left header tank 52. The refrigerant having entered the super-cooling section inlet header section 11 enters the heat exchange tubes 3 of the fourth heat exchange path P4 and is super-cooled while flowing rightward within the heat exchange tubes 3. The super-cooled refrigerant enters the super-cooling section outlet header section 14 of the right header tank 53 and flows out through the refrigerant outlet 16 and the refrigerant outlet member 18. The refrigerant is then fed to the evaporator through the expansion valve.

In the above-described condenser 50, since a pressure loss is generated when the refrigerant flows from the condensation section outlet header section 9 into the first space 66 and when the refrigerant flows from the first space 66 into the second space 67, a clear difference in the pressure condition of the refrigerant is produced between the interior of the condensation section outlet header section 9 and the interior of the first space 66 and between the interior of the first space 66 and the interior of the second space 67. As a result, the state of the refrigerant in the third heat exchange path P3 communicating with the first space 66 can be made clearly different from the state of the refrigerant within the second space 67. Accordingly, as in the case of the condenser 1 of the first embodiment, the difference between the state of the refrigerant within the heat exchange tubes 3 which forms a lower portion of the third heat exchange path P3 and the state of the refrigerant within the second space 67 of the liquid receiving tank 51 becomes clear, and the liquid phase refrigerant which has been condensed and super cooled is restrained from accumulating within the heat exchange tubes 3 of the third heat exchange path P3, which is the refrigerant condensation path, whereby the refrigerant within the condenser 50 becomes less likely to be influenced by changes in the external environment such as temperature and wind speed. As a result, even in the case where the size of the condenser 50 is reduced, the stability of the condensation performance of the condensation section 50A against changes in the external environment is improved effectively. Therefore, even under a special external environment condition, the condensation section 50A stably exhibits an expected refrigerant condensation performance.

In the condenser 50 of the third embodiment, the heat exchange tubes 3 are not connected to the liquid receiving tank 51. Therefore, like the second partition member 260 shown in FIG. 7, the second partition member which divides the interior of the liquid receiving tank 51 into the first space 66 and the third space 68 may be integrally formed on the outer circumferential surface of the refrigerant flow member 27 and disposed in such a manner that its outer peripheral edge portion is in close contact with the inner circumferential surface of the liquid receiving tank 51 and the second partition member closes the gap between the inner circumferential surface of the liquid receiving tank 51 and the outer circumferential surface of the refrigerant flow member 27. Notably, the second partition member may be integrally formed on the outer circumferential surface of the large diameter portion 27*a* instead of being integrally formed on the outer circumferential surface of the small diameter portion 27*b*. Further, the refrigerant flow member 27 is not required to have the large diameter portion 27*a* and the small diameter portion 27*b*, and the entire outer circumferential surface of the refrigerant flow member 27 may have the same diameter. In the case where the entire outer circumferential surface of the refrigerant flow member 27 has the same diameter, the second partition member is integrally formed on the outer circumferential surface of a proper portion of the refrigerant flow member 27, its outer peripheral edge portion is in close contact with the inner circumferential surface of the liquid receiving tank 51, and the second partition member closes the gap between the inner circumferential surface of the liquid receiving tank 51 and the outer circumferential surface of the refrigerant flow member 27. In this case as well, the integral formation of the second partition member on the refrigerant flow member 27, coupled with the integral formation of the first partition member 25 on the refrigerant flow member 27, yields effects similar to those of the second partition member 260 shown in FIG. 7.

Notably, the integral formation of the second partition member on the refrigerant flow member 27 in the condenser 50 of the third embodiment presupposes that the liquid receiving tank 51 is composed of the base member 59 and the liquid receiving tank main body 61 removably attached to the base member 59.

The present invention comprises the following modes.

1) A condenser which has a condensation section, a super-cooling section provided below the condensation section, and a liquid receiving section provided between the condensation section and the super-cooling section and formed of a tubular member whose longitudinal direction coincides with a vertical direction and which is closed at upper end lower ends thereof, the condensation section including at least one refrigerant condensation path composed of a plurality of heat exchange tubes disposed in parallel such that their longitudinal direction coincides with a left-right direction and they are spaced apart from one another in the vertical direction, the super-cooling section including at least one refrigerant super-cooling path composed of a plurality of heat exchange tubes disposed in parallel such that their longitudinal direction coincides with the left-right direction and they are spaced apart from one another in the vertical direction, and refrigerant flowing out of the heat exchange tubes of the refrigerant condensation path at a lower end flowing into the heat exchange tubes of the refrigerant super-cooling path at an upper end, wherein the liquid receiving section includes a first space into which the refrigerant flows from the heat exchange tubes of the refrigerant condensation path at the lower end, a second space which is located above the first space, into which the refrigerant flows from the first space, and in which the refrigerant is separated into gaseous and liquid phases, and a third space which is located below the first space, into which the refrigerant flows from the second space, and from which the refrigerant flows into the heat exchange tubes of the refrigerant super-cooling path at the upper end; and a throttle is provided in a region through which the refrigerant flows from the first space into the second space.

2) A condenser according to par. 1), wherein a first partition member for dividing an interior of the liquid receiving section into the first space and the second space, a second partition member for dividing the interior of the liquid receiving section into the first space and the third space, and a refrigerant flow member having a refrigerant passage channel for establishing communication between the second space and the third space are provided within the liquid receiving section;

a refrigerant passage hole for establishing communication between the first space and the second space is formed in the first partition member;

the refrigerant having flowed into the first space from the heat exchange tubes of the refrigerant condensation path at the lower end flows into the second space through the refrigerant passage hole of the first partition member, flows into the third space through the refrigerant passage channel of the refrigerant flow member, and then flows into the heat exchange tubes of the refrigerant super-cooling path at the upper end; and the refrigerant passage hole of the first partition member serves as a throttle for the refrigerant flowing from the first space into the second space.

3) A condenser according to par. 2), wherein the refrigerant flow member is composed of a tubular member whose upper end is located above the first partition member, whose lower end is located below the second partition member, and whose interior serves as the refrigerant passage channel;

the first partition member and the second partition member are provided in such a manner that they close a gap between an inner circumferential surface of the liquid receiving section and an outer circumferential surface of the refrigerant flow member;

a first communication opening for establishing communication between the refrigerant passage channel of the refrigerant flow member and the second space is formed in a portion of the refrigerant flow member located above the first partition member, a second communication opening for establishing communication between the refrigerant passage channel of the refrigerant flow member and the third space is formed in a portion of the refrigerant flow member located below the second partition member, and communication is not established between the refrigerant passage channel of the refrigerant flow member and the first space; and the refrigerant having flowed into the refrigerant passage channel through the first communication opening flows into the third space through the second communication opening without flowing into the first space.

4) A condenser according to any one of pars. 1) to 3), wherein the condensation section has a condensation section outlet header section which is provided separately from the liquid receiving section and with which end portions of heat exchange tubes of the refrigerant condensation path at the lower end communicate, the end portions being located on a downstream side in a refrigerant flow direction;

the super-cooling section has a super-cooling section inlet header section which is located on the same side as the condensation section outlet header section in the left-right direction and is located below the condensation section outlet header section and with which end portions of the heat exchange tubes of the refrigerant super-cooling path at the upper end communicate, the end portions being located on an upstream side in the refrigerant flow direction;

a lower end of the liquid receiving section is located below a lower end of the condensation section outlet header section, and an upper end of the liquid receiving section is located above the lower end of the condensation section outlet header section;

a communication member having a communication passage is provided between the liquid receiving section and the condensation section outlet header section, and the first space of the liquid receiving section communicates with the condensation section outlet header section through the communication passage of the communication member so that the refrigerant having flowed out of the condensation section outlet header section flows into the first space of the liquid receiving section through the communication passage of the communication member; and the communication passage of the communication member serves as a throttle for the refrigerant flowing from the condensation section outlet header section into the first space of the liquid receiving section.

5) A condenser according to par. 4), wherein a channel cross-sectional area of the communication passage of the communication member is equal to or less than a total channel cross-sectional area of all the heat exchange tubes communicating with the condensation section outlet header section.

6) A condenser according to par. 4) or 5), wherein a first header tank to which all the heat exchange tubes of the condensation section are connected and a second header tank to which all the heat exchange tubes of the super-cooling section are connected are disposed at a left end or right end of the condenser in such a manner that the second header tank is located outward of the first header tank in the left-right direction;

the second header tank also serves as the liquid receiving section;

the condensation section outlet header section is provided in the first header tank;

a lower end of the second header tank is located below a lower end of the first header tank, and an upper end of the second header tank is located above the lower end of the first header tank;

all the heat exchange tubes of the super-cooling section are connected to a portion of the second header tank located below the lower end of the first header tank;

the super-cooling section inlet header section is provided in a portion of the second header tank located below the lower end of the first header tank; and the first space is provided in a portion of the second header tank located above the lower end of the condensation section outlet header section, and the third space is provided in a portion of the second header tank located below the lower end of the condensation section outlet header section; and the third space of the second header tank also serves as the super-cooling section inlet header section.

7) A condenser according to par. 6), wherein the condensation section has a single refrigerant condensation path, the condensation section outlet header section is provided over the entirety of the first header tank, and all the heat exchange tubes of the refrigerant condensation path are connected to the condensation section outlet header section; and the super-cooling section has a single refrigerant super-cooling path, the super-cooling section inlet header section is provided over the entirety of a portion of the second header tank located below the lower end of the first header tank, and all the heat exchange tubes of the refrigerant super-cooling path are connected to the super-cooling section inlet header section.

8) A condenser according to par. 4) or 5), wherein a header tank to which all the heat exchange tubes of the condensation section and the super-cooling section are connected and a liquid receiving section formed separately from the header tank are disposed at a left end or right end of the condenser;

an interior of the header tank is divided into upper and lower tank portions by a partition member, all the heat exchange tubes of the condensation section are connected to the upper tank portion of the header tank, and all the heat exchange tubes of the super-cooling section are connected to the lower tank portion of the header tank;

the condensation section outlet header section is provided in the upper tank portion of the header tank, the super-cooling section inlet header section is provided in the lower tank portion of the header tank, and the first space is provided in a portion of the liquid receiving section located above the lower end of the condensation section outlet header section;

the third space of the liquid receiving section communicates with the super-cooling section inlet header section through a second communication member having a communication passage; and the refrigerant having flowed out of the third space of the liquid receiving section flows into the super-cooling section inlet header section of the header tank through the communication passage of the second communication member.

9) A condenser according to any one of pars. 1) through 3), wherein the condensation section has at least two refrigerant condensation paths and a condensation section outlet header section with which end portions of heat exchange tubes of the refrigerant condensation path at the lower end communicate, the end portions being located on a downstream side in a refrigerant flow direction;

the super-cooling section has at least one refrigerant super-cooling path and a super-cooling section inlet header section which is located on the same side as the condensation section outlet header section in the left-right direction and is located below the condensation section outlet header section and with which end portions of the heat exchange tubes of the refrigerant super-cooling path at the upper end communicate, the end portions being located on an upstream side in the refrigerant flow direction;

a lower end of the liquid receiving section is located below a lower end of the condensation section outlet header section, and an upper end of the liquid receiving section is located above the lower end of the condensation section outlet header section;

a first header tank and a second header tank are disposed at a left or right end of the condenser in such a manner that the second header tank is located outward of the first header tank in the left-right direction, the heat exchange tubes of the condensation section excluding the heat exchange tubes of the lower-end refrigerant condensation path being connected to the first header tank, and the heat exchange tubes of the lower-end refrigerant condensation path of the condensation section and all the heat exchange tubes of the super-cooling section being connected to the second header tank;

the second header tank also serves as the liquid receiving section;

a lower end of the second header tank is located below a lower end of the first header tank, and an upper end of the second header tank is located above the lower end of the first header tank;

the heat exchange tubes of the lower-end refrigerant condensation path of the condensation section and all the heat exchange tubes of the super-cooling section are connected to a portion of the second header tank located below the lower end of the first header tank;

the condensation section outlet header section and the super-cooling section inlet header section are provided in a portion of the second header tank located below the lower end of the first header tank in such a manner that the former is located above the latter;

the first space is provided in a portion of the second header tank to which the heat exchange tubes of the lower-end refrigerant condensation path of the condensation section are connected;

the third space is provided in a portion of the second header tank to which the heat exchange tubes of the upper-end refrigerant super-cooling path of the super-cooling section are connected; and the first space of the second header tank also serves as the condensation section outlet header section, and the third space of the second header tank also serves as the super-cooling section inlet header section.

10) A condenser according to par. 9), wherein the super-cooling section has a single refrigerant super-cooling path, and all the heat exchange tubes of the refrigerant super-cooling path are connected to the super-cooling section inlet header section.

The condenser of any one of pars. 1) to 10) has a condensation section, a super-cooling section provided below the condensation section, and a liquid receiving section provided between the condensation section and the super-cooling section and formed of a tubular member whose longitudinal direction coincides with a vertical direction and which is closed at upper end lower ends thereof. In the condenser, the liquid receiving section includes a first space into which the refrigerant flows from the heat exchange tubes of the refrigerant condensation path at the lower end, a second space which is located above the first space, into which the refrigerant flows from the first space, and in which the refrigerant is separated into gaseous and liquid phases, and a third space which is located below the first space, into which the refrigerant flows from the second space, and from which the refrigerant flows into the heat exchange tubes of the refrigerant super-cooling path at the upper end; and a throttle is provided in a region through which the refrigerant flows from the first space into the second space. Therefore, due to the action of the throttle, a pressure loss is generated when the refrigerant flows from the first space into the second space, and a clear difference in the pressure condition of the refrigerant is produced between the interior of the first space and the interior of the second space. Accordingly, it becomes possible to make clear the difference in the state of the refrigerant between the second space and the lower-end refrigerant condensation path of the condensation section which communicates with the first space. Thus, the liquid phase refrigerant which has been condensed and super cooled is restrained from accumulating within the heat exchange tubes of the lower-end refrigerant condensation path, whereby the refrigerant within the condenser becomes less likely to be influenced by changes in the external environment such as temperature and wind speed. As a result, even in the case where the size of the condenser is reduced, the stability of the condensation performance of the condensation section against changes in the external environment is improved. Therefore, even under a special external environment condition, the condensation section stably exhibits an expected refrigerant condensation performance.

According to the condenser of any one of pars. 1) to 10), the refrigerant is separated into gaseous and liquid phases in the second space. However, since the refrigerant flows upward from the first space into the second space, the gas-liquid separation function is improved.

According to the condenser of par. 2), by a relatively simple structure, it is possible to provide the first space, the second space, and the third space in the liquid receiving section and provide the throttle in the region through which the refrigerant flows from the first space into the second space.

According to the condenser of par. 4), the communication passage of the communication member for establishing communication between the condensation section outlet header section and the first space of the liquid receiving section serves as a throttle for the refrigerant flowing from the condensation section outlet header section to the first space of the liquid receiving section. Therefore, due to the action of the communication passage of the communication member, a pressure loss is generated when the refrigerant flows from the condensation section outlet header section into the first space, and a clear difference in the pressure condition of the refrigerant is produced between the interior of the condensation section outlet header section and the interior of the first space. Accordingly, it becomes possible to more effectively make clear the difference in the state of the refrigerant between the second space and the lower-end refrigerant condensation path of the condensation section which communicates with the first space through the condensation section outlet header section and the communication member. Accordingly, the refrigerant within the condenser becomes less likely to be influenced by changes in the external environment such as temperature and wind speed. As a result, even in the case where the size of the condenser is reduced, the stability of the condensation performance of the condensation section against changes in the external environment is improved effectively. Therefore, even under a special external environment condition, the condensation section stably exhibits an expected refrigerant condensation performance.

According to the condenser of par. 5), the action of the communication passage of the communication member as the throttle becomes remarkable.

What is claimed is:

1. A condenser comprising:

a condensation section including heat exchange tubes;

a super-cooling section including heat exchange tubes and provided at a downstream of the condensation section and below the condensation section in a height direction along a height of the condenser; and a liquid receiving section connected to the condensation section and the super-cooling section such that refrigerant flows from the condensation section to the super-cooling section via the liquid receiving section, the liquid receiving section comprising:

a first space which is connected to the condensation section and into which the refrigerant flows from the condensation section;

a second space located above the first space in the height direction and connected to the first space via a throttle such that the refrigerant flows from the first space to the second space via the throttle; and a third space located below the first space in the height direction and connected to the second space such that the refrigerant flows from the second space to the super-cooling section via the third space, wherein the liquid receiving section comprises:

a first partition dividing an interior of the liquid receiving section into the first space and the second space and including a refrigerant passage hole connecting the first space and the second space such that the refrigerant flows from the first space to the second space via the refrigerant passage hole which serves as the throttle;

a second partition dividing the interior into the first space and the third space; and a refrigerant flow pipe having a refrigerant passage channel connecting the second space and the third space such that the refrigerant flows from the second space to the third space via the refrigerant passage channel, wherein an upper end of the refrigerant flow pipe is located above the first partition, a lower end of the refrigerant flow pipe is located below the second partition, and whose interior serves as the refrigerant passage channel;

the first partition and the second partition are provided in such a manner that they close a gap between an inner circumferential surface of the liquid receiving section and an outer circumferential surface of the refrigerant flow pipe;

a first communication opening for establishing communication between the refrigerant passage channel of the refrigerant flow pipe and the second space is formed in a portion of the refrigerant flow pipe located above the first partition, a second communication opening for establishing communication between the refrigerant passage channel of the refrigerant flow pipe and the third space is formed in a portion of the refrigerant flow pipe located below the second partition, and communication is not established between the refrigerant passage channel of the refrigerant flow pipe and the first space; and the refrigerant flowed into the refrigerant passage channel through the first communication opening flows into the third space through the second communication opening without flowing into the first space.

2. A condenser comprising:

a condensation section including heat exchange tubes;

a super-cooling section including heat exchange tubes and provided at a downstream of the condensation section and below the condensation section in a height direction along a height of the condenser; and a liquid receiving section connected to the condensation section and the super-cooling section such that refrigerant flows from the condensation section to the super-cooling section via the liquid receiving section, the liquid receiving section comprising:

a first space which is connected to the condensation section and into which the refrigerant flows from the condensation section;

a second space located above the first space in the height direction and connected to the first space via a throttle such that the refrigerant flows from the first space to the second space via the throttle; and a third space located below the first space in the height direction and connected to the second space such that the refrigerant flows from the second space to the super-cooling section via the third space wherein the condensation section has a condensation section outlet header section which is provided separately from the liquid receiving section and with which first end portions of heat exchange tubes of the condensation section at a lower end communicate, the first end portions being located on a downstream side in a refrigerant flow direction;

the super-cooling section has a super-cooling section inlet header section which is located on a same side as the condensation section outlet header section in a left-right direction and is located below the condensation section outlet header section and with which second end portions of the heat exchange tubes of the super-cooling section at an upper end communicate, the second end portions being located on an upstream side in the refrigerant flow direction;

a lower end of the liquid receiving section is located below a lower end of the condensation section outlet header section, and an upper end of the liquid receiving section is located above the lower end of the condensation section outlet header section;

a communication passage is provided between the liquid receiving section and the condensation section outlet header section, and the first space of the liquid receiving section communicates with the condensation section outlet header section through the communication passage so that the refrigerant flowed out of the condensation section outlet header section flows into the first space of the liquid receiving section through the communication passage; and the communication passage serves as a throttle for the refrigerant flowing from the condensation section outlet header section into the first space of the liquid receiving section.

3. The condenser according to claim 2, wherein a channel cross-sectional area of the communication passage is equal to or less than a total channel cross-sectional area of all the heat exchange tubes communicating with the condensation section outlet header section.

4. The condenser according to claim 2, wherein a first header tank to which all the heat exchange tubes of the condensation section are connected and a second header tank to which all the heat exchange tubes of the super-cooling section are connected are disposed at a left end or right end of the condenser in such a manner that the second header tank is located outward of the first header tank in the left-right direction;

the second header tank also serves as the liquid receiving section;

the condensation section outlet header section is provided in the first header tank;

a lower end of the second header tank is located below a lower end of the first header tank, and an upper end of the second header tank is located above the lower end of the first header tank;

all of the heat exchange tubes of the super-cooling section are connected to a portion of the second header tank located below the lower end of the first header tank;

the super-cooling section inlet header section is provided in a portion of the second header tank located below the lower end of the first header tank; and the first space is provided in a portion of the second header tank located above the lower end of the condensation section outlet header section, and the third space is provided in a portion of the second header tank located below the lower end of the condensation section outlet header section; and the third space of the second header tank also serves as the super-cooling section inlet header section.

* * * * *